United States Patent [19]

Scharf et al.

[11] Patent Number: 4,752,416

[45] Date of Patent: Jun. 21, 1988

[54] PHOSPHITE ESTER COMPOSITIONS, AND LUBRICANTS AND FUNCTIONAL FLUIDS CONTAINING SAME

[75] Inventors: Curtis R. Scharf, Wickliffe; Stephen A. DiBiase, Euclid; William C. Tritt, S. Euclid, all of Ohio

[73] Assignee: The Lubrizol Corporation, Wickliffe, Ohio

[21] Appl. No.: 940,693

[22] Filed: Dec. 11, 1986

[51] Int. Cl.[4] ..... C01M 105/74; C01M 173/02

[52] U.S. Cl. ..... 252/78.5; 252/49.8; 252/75; 558/214

[58] Field of Search ..... 252/75, 78.5, 49.8; 558/214

[56] References Cited

U.S. PATENT DOCUMENTS

| | | | |
|---|---|---|---|
| Re. 27,331 | 4/1972 | Coleman | 252/47.5 |
| 2,012,446 | 8/1935 | Edwards et al. | 260/17 |
| 2,570,050 | 10/1951 | Elby | 260/601 |
| 2,776,997 | 1/1957 | Doumani | 260/609 |
| 2,863,799 | 12/1958 | Goodhue et al. | 167/22 |
| 3,115,465 | 12/1963 | Orloff et al. | 252/49.9 |
| 3,256,185 | 6/1966 | Le Suer | 252/47.5 |
| 3,419,614 | 12/1968 | Doss | 260/583 |
| 3,556,999 | 1/1971 | Messina et al. | 252/78 |
| 3,583,915 | 6/1971 | Myers | 252/49.8 |
| 3,600,372 | 8/1971 | Udelhofen et al. | 260/132 |
| 3,632,566 | 1/1972 | Coleman | 260/125 |
| 3,953,347 | 4/1976 | Habiby | 252/48.6 |
| 4,029,587 | 6/1977 | Koch | 252/48.2 |
| 4,029,588 | 6/1977 | Koch | 252/48.2 |
| 4,031,023 | 6/1977 | Musser et al. | 252/48.2 |
| 4,116,877 | 9/1978 | Outten et al. | 252/72 |
| 4,119,549 | 10/1978 | Davis | 252/45 |
| 4,146,489 | 3/1979 | Stambaugh et al. | 252/50 |
| 4,160,739 | 7/1979 | Stambaugh et al. | 252/34 |
| 4,161,452 | 7/1979 | Stambaugh et al. | 252/34 |
| 4,161,475 | 7/1979 | Davis | 260/132 |
| 4,191,659 | 3/1980 | Davis | 252/45 |
| 4,256,596 | 3/1981 | Cohen | 252/52 |
| 4,584,113 | 4/1986 | Walsh | 252/45 |

OTHER PUBLICATIONS

Jones et al., "Addition of Sulfur and Sulfides to Unsaturated Hydrocarbons," J. Am. Chem. Soc., vol. 60, pp. 2452–2455, 1938.

Landis, "The Chemistry of 1,2-Dithiole-3-Thiones," Chem. Rev., vol. 65, pp. 237–245, 1965.

*Primary Examiner*—Robert Wax

*Attorney, Agent, or Firm*—Denis A. Polyn; Forrest L. Collins; Karl Bozicevic

[57] ABSTRACT

Lubricating and functional fluid compositions are described which comprise at least one oil of lubricating viscosity and an extreme-pressure and friction-modifying amount of (A) at least one phosphite ester characterized by the formula

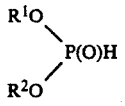

(I)

wherein $R^1$ is a straight-chain hydrocarbyl group and $R^2$ is a branched-chain hydrocarbyl group. The invention also relates to compositions which comprise the combination of such phosphite esters as represented by Formula I and various sulfur-containing compositions. The compositions comprising said combinations also are useful in lubricating and functional fluid compositions including lubricating oils and greases. Aqueous systems containing the phosphite esters represented by Formula I as well as combinations of phosphite esters with sulfur-containing compositions also are described.

37 Claims, No Drawings

PHOSPHITE ESTER COMPOSITIONS, AND LUBRICANTS AND FUNCTIONAL FLUIDS CONTAINING SAME

TECHNICAL FIELD OF THE INVENTION

This invention relates to compositions comprising combinations of certain phosphite esters and at least one sulfur-containing composition. The phosphite esters are useful, either alone or in combination with the sulfur-containing composition in lubricating compositions, and in particular, in lubricating compositions useful in automatic transmission and manual transmission fluids and in gear lubricants.

BACKGROUND OF THE INVENTION

Organophosphorus and metal organophosphorus compounds are used extensively in lubricating oils and greases as extreme pressure agents and anti-wear agents. Examples of such compounds include: phosphosulfurized hydrocarbons such as the reaction product of a phosphorus sulfide with turpentine; phosphorus esters including dihydrocarbon and trihydrocarbon phosphites; and metal phosphorodithioates such as zinc dialkylphosphorodithioates.

Hydraulic fluid compositions, particularly automatic transmission fluid compositions, containing a phosphite or a di-substituted phosphate in combination with other additives is described in U.S. Pat. No. 3,556,999. The phosphites my be mono-, di- or tri-substituted phosphites, and where the substituent is an alkyl group. The alkyl group may be present in any of its known configurations such as normal, iso, or tertiary. Other patents describing the use of phosphites, including dialkyl hydrogen phosphites in lubricating formulations include, for example, U.S. Pat. Nos. 3,115,465; 4,029,587; 4,029,588; 4,031,023; 4,116,877; 4,146,489; 4,160,739; 4,161,452; and 4,256,596.

It also is well known that many sulfurized organic compositions are useful as lubricant additives. Typical sulfurized compositions prepared by reacting olefins such as isobutene, diisobutene, and triisobutene with sulfur under various conditions are described in, for example, *Chemical Reviews*, 65, 237 (1965). Other references describe the reaction of such olefins with hydrogen sulfide to form predominantly mercaptans with sulfides, disulfides and higher polysulfides also being formed as by-products. Reference is made to *J. Am. Chem. Soc.*, 60, 2452 (1938), and U.S. Pat. No. 3,419,614. The patent describes a process for increasing the yield of mercaptan by carrying out the reaction of olefin with hydrogen sulfide and sulfur at a high temperature in the presence of various basic materials.

It also has been known that Diels-Alder adducts can be sulfurized to form sulfur-containing compositions which are particularly useful as extreme pressure and anti-wear additives in various lubricating oils. U.S. Pat. Nos. 3,632,566 and Re. 27,331 describe such sulfurized Diels-Alder adducts and lubricants containing said adducts. In these patents, the ratio of sulfur to Diels-Alder adduct is described as being a molar ratio of from about 0.5:1.0 to 10.0:1.0. The disclosed lubricating compositions may contain other additives normally used to improve the properties of lubricating compositions such as dispersants, detergents, extreme pressure agents, and additional oxidation and corrosion-inhibiting agents, etc.

U.S. Pat. No. 4,191,659 describes the preparation of sulfurized olefinic compounds by the catalytic reaction of sulfur and hydrogen sulfide with olefinic compounds containing from 3 to 30 carbon atoms. Such compounds are reported to being useful in lubricating compositions, particularly those prepared for use as industrial gear lubricants. U.S. Pat. No. 4,119,549 describes a similar procedure for sulfurizing olefins, particularly fatty acids, utilizing sulfur and hydrogen sulfide following by removal of low boiling materials from said sulfurized mixture.

Other sulfurized compositions of matter also have been suggested as compositions useful as additives for lubricants. U.S. Pat. No. 2,012,446 describes a method of sulfurizing pine oil which is reported as being useful as an additive for lubricant manufacture. U.S. Pat. No. 3,953,347 describes a sulfurized composition of matter which is prepared by reacting sulfur with a mixture of at least one fatty acid ester of a polyhydric alcohol, at least one fatty acid and at least one aliphatic alpha-olefin. These latter compositions are suitable as replacements for sulfurized sperm oil as extreme pressure additives in lubricants. U.S. Pat. No. 4,584,113 describes sulfurized compositions prepared by sulfurizing a mixture of at least one terpene (e.g., pine oil) and at least one other olefinic compound. These sulfurized compositions are useful in lubricants, particularly industrial and gear lubricants.

The preparation of hydroxythioethers and their use in lubricating oil compositions is described in U.S. Pat. No. 4,031,023. The lubricating compositions containing the described hydroxythioethers exhibit increased resistance to oxidative degradation and wear. Other patents including descriptions of the preparation of suitable hydroxythioethers include U.S. Pat. Nos. 2,570,050; 2,776,997; and 2,863,799.

Sulfurized Mannich condensation products made from phenolic compounds, aldehydes and amines have been described in U.S. Pat. No. 4,161,475, and the use of such condensation products in lubricating oils are suggested therein. The sulfurized products are obtained by reacting the Mannich condensation products with elemental sulfur. Often techniques for sulfurizing Mannich condensation products, and the prior art disclosing such procedures is summarized in U.S. Pat. No. 4,161,475. U.S. Pat. No. 3,600,372, for example, describes the treatment of Mannich condensates with carbon disulfide.

The increasing demands for improved effectiveness of lubricants and functional fluids, as well as the increasingly severe conditions under which such materials are expected to perform requires a continuing search for new and improved additives, particularly additives which are capable of performing more than one function. For example, it is important that additives useful as extreme pressure additives also exhibit good frictional characteristics. Some additives are known which perform very well as extreme pressure additives but are weak from a frictional characteristic standpoint. Similarly, some additives exhibit acceptable frictional characteristics but are deficient in extreme pressure properties.

SUMMARY OF THE INVENTION

Lubricating and functional fluid compositions are described which comprise at least one oil of lubricating viscosity and an extreme-pressure and friction-modifying amount of (A) at least one phosphite ester characterized by the formula

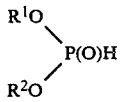

(I)

wherein $R^1$ is a straight-chain hydrocarbyl group and $R^2$ is a branched-chain hydrocarbyl group. The invention also relates to compositions which comprise the combination of such phosphite esters as represented by Formula I and various sulfur-containing compositions. The compositions comprising said combinations also are useful in lubricating and functional fluid compositions including lubricating oils and greases. Aqueous systems containing the phosphite esters represented by Formula I as well as combinations of phosphite esters with sulfur-containing compositions also are described.

DESCRIPTION OF THE PREFERRED EMBODIMENTS (A) The Phosphite Ester

The phosphite esters which are included in the compositions of the present invention are characterized by the formula

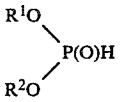

(I)

wherein $R^1$ is a straight-chain hydrocarbyl group and $R^2$ is a branched-chain hydrocarbyl group. In one embodiment, the hydrocarbyl groups $R^1$ and $R^2$ each contain up to about 30 carbon atoms and more generally, $R^1$ is an alkyl group containing from 1 to about 30 carbon atoms and $R^2$ is an alkyl group containing from 4 to about 30 carbon atoms. Examples of the straight-chain hydrocarbyl groups $R^1$ include methyl, ethyl, n-propyl, n-butyl, n-hexyl, n-octyl, n-decyl, n-dodecyl, n-tetradecyl, stearyl, n-hexadecyl, n-octadecyl, oleyl, cetyl, etc. Examples of branched-chain hydrocarbyl groups ($R^2$) include, isopropyl, isobutyl, secondary butyl, tertiary butyl, neopentyl, 2-ethylhexyl, 2,6-dimethylheptyl, etc.

As used in this specification and appended claims, the terms "hydrocarbyl" or "hydrocarbon-based" denote a group having a carbon atom directly attached to the remainder of the molecule and having predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based group", "aryl-based group" and the like have meaning analogous to the above with respect to alkyl and aryl groups and the like.

The $R^1$ group may comprise a mixture of hydrocarbyl groups derived from commercial alcohols. Examples of some preferred monohydric alcohols and alcohol mixtures include the commercially available "Alfol" alcohols marketed by Continental Oil Corporation. Alfol 810 is a mixture containing alcohols consisting essentially of straight chain, primary alcohols having from 8 to 10 carbon atoms. Alfol 12 is a mixture comprising mostly $C_{12}$ fatty alcohols. Alfol 1218 is a mixture of synthetic, primary, straight-chain alcohols having 12 to 18 carbon atoms. The Alfol 20+ alcohols are mixtures of $C_{18-28}$ primary alcohols having mostly, on an alcohol basis, $C_{20}$ alcohols as determined by GLC (gas-liquid-chromatography). The Alfol 22+ alcohols are $C_{18-28}$ primary alcohols having mostly, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Aldol 60 which comprises about 75% by weight of a straight chain $C_{22}$ primary alcohol, about 15% of a $C_{20}$ primary alcohol and about 8% of $C_{18}$ and $C_{24}$ alcohols. Aldol 320 comprises predominantly oleyl alcohol. The Aldol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

The dihydrocarbyl phosphites (A) useful in the present invention may be prepared by techniques well known in the art, and many dihydrocarbyl phosphites are available commercially. In one method of preparation, a lower molecular weight dialkylphosphite (e.g., dimethyl) is reacted with a mixture of alcohols comprising a straight-chain alcohol and a branched-chain alcohol. As noted above, each of the two types of alcohols may themselves comprise mixtures. Thus, the straight-chain alcohol may comprise a mixture of straight-chain alcohols and the branched-chain alcohol may comprise a mixture of branched-chain alcohols. The higher molecular weight alcohols replace the methyl groups (analogous to classic transesterification) with the formation of methanol which is stripped from the reaction mixture.

In another embodiment, the branched chain hydrocarbyl group can be introduced into a dialkylphosphite by reacting the low molecular weight dialkylphosphite such as dimethylphosphite with a more stearically hindered branched-chain alcohol such as neopentyl alcohol (2,2-dimethyl-1-propanol). In this reaction, one of the methyl groups is replaced by a neopentyl group, and, apparently because of the size of the neopentyl group, the second methyl group is not displaced by the neopentyl alcohol.

The following examples illustrate the preparation of the phosphite esters (A) which are useful in the compositions of the present invention. Unless otherwise indicated in the following examples and elsewhere in the specification and claims, all parts and percentages are by weight, and all temperatures are in degrees centigrade.

EXAMPLE A-1

A mixture of 911.4 parts (7 moles) of 2-ethylhexanol, 1022 parts (7 moles) of Alfol 8–10, and 777.7 parts (7 moles) of dimethylphosphite is prepared and heated to 125° C. while sparging with nitrogen and removing methanol as a distillate. After about 6 hours, the mixture is heated to 145° C. and maintained at this temperature for an additional 6 hours whereupon about 406 parts of distillate are recovered. The reaction mixture is stripped to 150° C. at 50 mm. Hg., and an additional 40 parts of distillate are recovered. The residue is filtered through a filter aid and the filtrate is the desired mixed phosphite containing 9.6% phosphorus (theory, 9.7%).

EXAMPLE A-2

A mixture of 468.7 parts (3.6 moles) of 2-ethylhexanol, 1050.8 parts (7.20 moles) of Alfol 8–10, and 600 parts (5.4 moles) of dimethylphosphite is prepared and heated to 135° C. while purging with nitrogen. The mixture is heated slowly to 145° C. and maintained at this temperature for about 6 hours whereupon a total of 183.4 parts of distillate are recovered. The residue is vacuum stripped to 145° C. (10 mm. Hg.) and 146.3 parts of additional distillate are recovered. The residue is filtered through a filter aid, and the filtrate is the desired product containing 9.3% phosphorus (theory, 9.45%).

EXAMPLE A-3

A mixture of 518 parts (7 moles) of n-butanol, 911.4 parts (7 moles) of 2-ethylhexanol, and 777.7 parts (7 moles) of dimethylphosphite is prepared and heated to 120° C. while blowing with nitrogen. After about 7 hours, 322.4 parts of distillate are collected, and the material then is vacuum stripped (50 mm. Hg. at 140° C.) whereupon an additional 198.1 parts of distillate are recovered. The residue is filtered through a filter aid, and the filtrate is the desired product containing 12.9% phosphorus (theory, 12.3%).

EXAMPLE A-4

A mixture of 193 parts (2.2 moles) of 2,2-dimethyl-1-propanol and 242 parts (2.2 moles) of dimethylphosphite is prepared and heated to about 120° C. while blowing with nitrogen. A distillate is removed and collected, and the residue is vacuum stripped. The residue is filtered and the filtrate is the desired product containing 14.2% phosphorus.

(B) The Sulfur-Containing Compositions

The compositions of the present invention also comprise mixtures of the above-described phosphite esters (A) as represented by Formula I and (B) at least one sulfur-containing composition. The weight ratio of (A:B) may range from about 1:10 to 10:1.

(B-1) Sulfurized Olefins

The sulfur-containing composition may be (B-1) at least one sulfurized olefin.

Organic polysulfides may be prepared by the sulfochlorination of olefins containing four or more carbon atoms and further treatment with inorganic higher polysulfides according to U.S. Pat. No. 2,708,199.

In one embodiment, useful sulfurized olefins are produced by (1) reacting sulfur monochloride with a stoichiometric excess of a low carbon atom olefin, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to 5 carbon atoms and examples include ethylene, propylene, butylene, isobutylene, amylene, etc. Briefly, in the first step, sulfur monochloride is reacted with from one to two moles of the olefin per mole of the sulfur monochloride, and the reaction is conducted by mixing the reactants at a temperature of from about 20° to 80° C. In the second step, the product of the first step is reacted with an alkali metal, preferably sodium sulfide, and sulfur. The mixture consists of up to about 2.2 moles of the metal sulfide per gram-atom of sulfur, and the mole ratio of alkali metal sulfide to the product of the first step is about 0.8 to about 1.2 moles of metal sulfide per mole of step (1) product. Generally, the second step is conducted in the presence of an alcohol or an alcohol-water solvent under reflux conditions. The third step of the process is the reaction between the phosphosulfurized olefin which contains from about 1 to about 3% of chlorine with an inorganic base in a water solution. Alkali metal hydroxide such as sodium hydroxide may be used. The reaction is continued until the chlorine content is reduced to below 0.5%, and this reaction is conducted under reflux conditions for a period of from about 1 to 24 hours.

The sulfurized olefins which are useful in the compositions of the present invention also may be prepared by the reaction, under superatmospheric pressure, of olefinic compounds with a mixture of sulfur and hydrogen sulfide in the presence of a catalyst, followed by removal of low boiling materials. This procedure for preparing sulfurized compositions which are useful in the present invention is described in U.S. Pat. No. 4,191,659, the disclosure of which is hereby incorporated by reference for its description of the preparation of useful sulfurized compositions. An optional final step described in this patent is the removal of active sulfur by, for example, treatment with an alkali metal sulfide.

The olefinic compounds which may be sulfurized by this method are diverse in nature. They contain at least one olefinic double bond, which is defined as a nonaromatic double bond; that is, one connecting two aliphatic carbon atoms. In its broadest sense, the olefin may be defined by the formula $$R^1R^2C{=}CR^3R^4$$

wherein each of $R^1$, $R^2$, $R^3$ and $R^4$ is hydrogen or an organic group. In general, the R groups in the above formula which are not hydrogen may be satisfied by such groups as $-C(R^5)_3$, $-COOR^5$, $-CON(R^5)_2$, $-COON(R^5)_4$, —COOM, —CN, —X, $-YR^5$ or —Ar, wherein:

each $R^5$ is independently hydrogen, alkyl, alkenyl, aryl, substituted alkyl, substituted alkenyl or substituted aryl, with the proviso that any two $R^5$ groups can be alkylene or substituted alkylene whereby a ring of up to about 12 carbon atoms is formed;

M is one equivalent of a metal cation (preferably Group I or II, e.g., sodium, potassium, barium, calcium);

X is halogen (e.g., chloro, bromo, or iodo);

Y is oxygen or divalent sulfur;

Ar is an aryl or substituted aryl group of up to about 12 carbon atoms.

Any two of $R^1$, $R^2$, $R^3$ and $R^4$ may also together form an alkylene or substituted alkylene group; i.e., the olefinic compound may be alicyclic.

The natures of the substituents in the substituted moieties described above are not normally critical and any such substituent is useful so long as it is or can be made compatible with lubricating environments and does not interfere under the contemplated reaction conditions. Thus, substituted compounds which are so unstable as to deleteriously decompose under the reaction conditions employed are not contemplated. However, certain substituents such as keto or aldehydo can desirably undergo sulfurization. The selection of suitable substituents is within the skill of the art or may be established through routine testing. Typical of such substituents include any of the above-listed moieties as well as hydroxy, amidine, amino, sulfonyl, sulfinyl, sulfonate, nitro, phosphate, phosphite, alkali metal mercapto and the like.

The olefinic compound is usually one in which each R group which is not hydrogen is independently alkyl, alkenyl or aryl, or (less often) a corresponding substituted group. Monoolefinic and diolefinic compounds, particularly the former, are preferred, and especially terminal monoolefinic hydrocarbons; that is, those compounds in which $R^3$ and $R^4$ are hydrogen and $R^1$ and $R^2$ are alkyl or aryl, especially alkyl (that is, the olefin is aliphatic). Olefinic compounds having about 3 to 30 and especially about 3 to 16 (most often less than 9) carbon atoms are particularly desirable.

Isobutene, propylene and their dimers, trimers and tetramers, and mixtures thereof are especially preferred olefinic compounds. Of these compounds, isobutylene and diisobutylene are particularly desirable because of their availability and the particularly high sulfur-containing compositions which can be prepared therefrom. Thus, commercial diisobutylene is believed to contain essentially two isomeric forms and this mixture is contemplated for use according to the present invention.

Commercial sources of sulfur and hydrogen sulfide are normally used for the purpose of this sulfurization reaction, and impurities normally associated therewith may be present without adverse results.

The amounts of sulfur and hydrogen sulfide per mole of olefinic compound are, respectively, about 0.3–3.0 gram-atoms and about 0.1–1.5 moles. The preferred ranges are about 0.5–2.0 gram-atoms and about 0.4–1.25 moles respectively. In batch operations, the reactants are introduced at levels to provide these ranges. In semi-continuous and continuous operations, they may be admixed at any ratio but on a mass balance basis, they are present so as to be consumed in amounts within these ratios. Thus, for example, if the reaction vessel is initially charged with sulfur alone, the olefinic compound and hydrogen sulfide are added incrementally at a rate such that the desired ratio is obtained.

The temperature range in which the sulfurization reaction is carried out is generally about 50°–350° C. The preferred range is about 100°–200° C., with about 125°–180° C. being especially suitable. The reaction is conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature, and the vapor pressure of the reactants and products and it may vary during the course of the reaction.

It is frequently advantageous to incorporate materials useful as sulfurization catalysts in the reaction mixture. These materials may be acidic, basic or neutral. Useful neutral and acidic materials include acidified clays such as "Super Filtrol", p-toluenesulfonic acid, dialkylphosphorodithioic acids, and phosphorus sulfides such as phosphorus pentasulfide.

The preferred catalysts are basic materials. These may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl groups are alkyl, aryl, aralkyl, alkaryl or the like and contain about 1–20 carbon atoms. Suitable amines include aniline, benzylamine, dibenzylamine, dodecylamine, morpholine, naphthylamine, tallow amines, N-ethyldipropylamine, N-phenylbenzylamine, N,N-diethylbutylamine, m-toluidine and 2,3-xylidine. Also useful are heterocyclic amines such as pyrrolidine, N-methylpyrrolidine, piperidine, pyridine and quinoline.

The amount of catalytic material used is generally about 0.05–2.0% of the weight of the olefinic compound. In the case of the preferred ammonia and amine catalysts, about 0.0005–0.5 mole per mole of olefin is preferred, and about 0.001–0.1 mole is especially desirable.

Also present in the reaction mixture may be water, either as a catalyst or as a diluent for one or more of the catalysts recited hereinabove. The amount of water, when present, is usually about 1–25% by weight of the olefinic compound. The presence of water is, however, not essential and when certain types of reaction equipment are used it may be advantageous to conduct the reaction under substantially anhydrous conditions.

The method is usually carried out in the absence of solvents and diluents other than water. However, it may sometimes be desirable to use a substantially inert, normally liquid organic diluent in the reaction. The nature of suitable diluents will readily be apparent to those skilled in the art.

The time required for the reaction to be completed will vary depending on the reagents, ratios thereof, the reaction temperature, the presence or absence of catalysts, and the purity of the reagents. The course of the reaction is conveniently followed by monitoring the pressure in the reaction vessel; the reaction can be considered complete when the pressure levels off to a constant value.

Following the preparation of the sulfurized mixture by the procedure described hereinabove, substantially all low boiling materials are removed. The nature of these low boiling materials will vary according to the amount and type of reactants used and the reaction conditions. It will also vary to some extent according to the use to which the sulfurized product is to be put, as well as such things as odor and flammability considerations, recycling needs of reactants and by-products, and the like. Most often, the product should have a flash point above about 30° C., preferably about 70° C. and desirably above about 100° C. as determined by ASTM Procedure D93. Reference is also made to ASTM Procedures D56 and D1310.

In addition to starting materials such as the olefinic compound, the low boiling materials will often include mercaptans and monosulfides, especially when the starting olefin contains less than 9 carbon atoms, and under these circumstances it is preferred that the product contain no more than about 5% by weight of such starting materials, mercaptans and monosulfides. If these materials are gaseous at ambient pressure and temperature, they may be removed in part simply by venting the reaction vessel, and they may be recycled if desired. In the case of less volatile starting materials, it may be necessary to resort to such techniques as distillation at atmospheric pressure or vacuum distillation or stripping. Another useful method is the passage of an inert gas such as nitrogen through the mixture at a suitable temperature and pressure. Largescale gas chromatography and molecular distillation may also be useful.

Any solids present in the reaction mixture may be conveniently removed, in most instances, by merely pouring off the liquid product. If further removal of solids is desired, such conventional techniques as filtration or centrifugation may be used.

A further optional step in the method is the treatment of the sulfurized product, obtained as described hereinabove, to reduce active sulfur. By "active sulfur" is meant sulfur in a form which can cause staining of copper and similar materials. When active sulfur is to be reduced, any of several methods known in the art may be employed. An illustrative method is treatment with an alkali metal sulfide as described in U.S. Pat. No. 3,498,915.

The exact chemical nature of the sulfurized compositions prepared in this manner is not known with certainty, and it is most convenient to describe them in terms of the method for their preparation. It appears, however, that when prepared from olefins containing less than 9 and particularly less than 7 carbon atoms, they comprise principally disulfides, trisulfides and tetrasulfides. The sulfur content of these sulfurized compositions is usually about 2–60% by weight, preferably about 25–60% and most desirably about 40–50%.

The method of preparing sulfurized olefins in this manner is illustrated by the following examples.

EXAMPLE B-1-A

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid.

The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

EXAMPLE B-1-B

Sulfur (151 parts) is charged to a reactor similar to the one described in Example B-1-A. The sulfur is heated to 160° C. and the reactor is sealed and evacuated. Hydrogen sulfide (72 parts) is added slowly to the reactor over a period of about 4.5 hours. Thereafter, 1.6 parts of the catalyst n-butylamine are added to the reactor after about 3.8 parts of hydrogen sulfide are added. Isobutylene (157 parts) is added slowly to the reactor containing the sulfur, catalyst, and about 10 parts of hydrogen sulfide in such a manner that the rates of addition of isobutylene and hydrogen sulfide are such as to maintain 10% molar excess of hydrogen sulfide until all the hydrogen sulfide is added. The addition of the remainder of isobutylene is continued until the entire 157 parts are added. The temperature is maintained in the range of between 160°–171° C. throughout the foregoing additions and reactions with occasional cooling being necessary. The reaction is held for 5 hours at 171° C., then unreacted hydrogen sulfide and isobutylene are vented to a recovery system until the pressure in the vessel is reduced to atmospheric. Separation of low boiling materials from the reaction crude is accomplished by nitrogen blowing, then vacuum stripping. The residue is then filtered. The filtrate is the desired sulfurized composition containing 47% sulfur by weight.

EXAMPLE B-1-C

Sulfur monochloride (2025 parts, 15.0 moles) is heated to 45° C. Through a sub-surface gas sparger, 1468 parts (26.2 moles of isobutylene gas) are fed into the reactor over a 5-hour period. The temperature is maintained between 45°–50° C. At the end of the sparging, the reaction mixture increases in weight of 1352 parts.

In a separate reaction vessel are added 2150 parts (16.5 moles) of 60% flake sodium sulfide, 240 parts (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C.

The reaction mixture is refluxed for 6 hours, and afterward the mixture is permitted to form into separate layers. The lower aqueous layer is discarded. The upper organic layer is mixed with two liters of 10% aqueous sodium hydroxide, and the mixture is refluxed for 6 hours. The organic layer is again removed and washed with one liter of water. The washed product is dried by heating at 90° C. and 30 mm. Hg. pressure for 30 minutes. The residue is filtered through diatomaceous earth filter aid to give 2070 parts of a clear yellow-orange liquid.

EXAMPLE B-1-D

Into a reactor is charged 102.8 parts of sulfur chloride under a nitrogen atmosphere which is maintained throughout the reaction, and about 718.5 parts of gaseous isobutylene are fed into the reactor through a submerged line. The isobutylene is added as rapidly as possible while maintaining the maximum batch temperature at about 49° C. with a cooling water bath. After all of the isobutylene is added, the bath temperature decreases indicating completion of the reaction.

In a separate vessel, a mixture of 340.3 parts of an 18% sodium sulfide solution and 363.8 parts of a 50% aqueous solution of sodium hydroxide is prepared, and 128.77 parts of a 55.7% isopropyl alcohol and water mixture recovered from a previous batch are added. This addition is equivalent to 71 parts of dry isopropyl alcohol. The mixture is agitated, circulated and heated under reflux to a temperature of about 74° C. over a 2-hour period. While maintaining the batch temperature between about 75°–80° C., 168.13 parts of the isobutylene, sulfur chloride reaction product prepared above are added over a 5-hour period. The reaction mixture is maintained at about 80° C. and agitated for about 5 hours. The mixture then is cooled to about 38° C. and allowed to settle. The organic phase (138.7 parts) is separated from the aqueous phase and stripped of any remaining water and volatile materials. A filter aid is added to the residue with stirring, and the mixture then is filtered at about 50°–65° C. The filtrate is the desired product containing about 43% sulfur.

In another embodiment, the sulfurized organic compound is derived from a particular type of cyclic or bicyclic olefin which is a Diels-Alder adduct of at least one dienophile with at least one aliphatic conjugated diene. The sulfurized Diels-Alder adducts can be prepared by reacting various sulfurizing agents with the Diels-Alder adducts as described more fully below. Preferably, the sulfurizing agent is sulfur.

The Diels-Alder adducts are a well-known, art-recognized class of compounds prepared by the diene synthesis or Diels-Alder reaction. A summary of the prior art relating to this class of compounds is found in the Russian monograph, *Dienovyi Sintes,* Izdatelstwo Akademii Nauk SSSR, 1963 by A. S. Onischenko. (Translated into the English language by L. Mandel as A. S. Onischenko, *Diene Synthesis,* N.Y., Daniel Davey and Co., Inc., 1964.) This monograph and references cited therein are incorporated by reference into the present specification.

Sulfurized Diels-Alder adducts are described in the art such as in U.S. Pat. No. 27,331, and the specification of this patent is hereby incorporated by reference for the disclosure of the preparation of a variety of such sulfurized adducts.

Briefly, the sulfur-containing compounds are prepared by heating a mixture of a sulfurizing agent such as sulfur, and at least one of the Diels-Alder adducts of the types discussed hereinabove at a temperature within the range of from about 110° C. to just below the decomposition temperature of the Diels-Alder adducts. Temperatures within the range of about 110° to about 200° C. will normally be used. This reaction results in a mixture of products, some of which have been identified. In the compounds of known structure, the sulfur reacts with the substituted, unsaturated, cycloaliphatic reactants at a double bond in the nucleus of the unsaturated reactant.

The molar ratio of sulfur to Diels-Alder adduct used in the preparation of the sulfur-containing composition is from about 0.5:1 to about 10:1 although the molar ratio generally will be less than about 4:1.

The sulfurizing reaction can be conducted in the presence of suitable inert organic solvents such as mineral oils, alkanes of 7 to 18 carbons, etc., although no solvent is generally necessary. After completion of the reaction, the reaction mass can be filtered and/or subjected to other conventional purification techniques. There is no need to separate the various sulfur-containing products as they can be employed in the form of a reaction mixture comprising the compounds of known and unknown structure.

As hydrogen sulfide is an undesirable contaminent, it is advantageous to employ standard procedures for assisting in the removal of the $H_2S$ from the products. Blowing with steam, alcohols, air, or nitrogen gas assists in the removal of $H_2S$ as does heating at reduced pressures with or without the blowing.

It is sometimes advantageous to incorporate materials useful as sulfurization catalysts in the reaction mixture. These materials may be acidic, basic or neutral. Useful neutral and acidic materials include acidified clays such as "Super Filtrol", p-toluene sulfonic acid, dialkylphosphorodithioic acids, phosphorus sulfides such as phosphorus pentasulfide and phosphites such as triaryl phosphites (e.g., triphenyl phosphite).

The basic materials may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl radicals are alkyl, aryl, aralkyl, alkaryl or the like and contain about 1–20 carbon atoms. Suitable amines include aniline, benzylamine, dibenzylamine, dodecylamine, naphthylamine, tallow amines, N-ethyldipropylamine, N-phenylbenzylamine, N,N-diethylbutylamine, m-toluidine and 2,3-xylidine. Also useful are heterocyclic amines such as pyrrolidine, N-methylpyrrolidine, piperidine, pyridine, morpholine and quinoline.

When a catalyst is used, the amount is generally about 0.05–2.0% of the weight of the adduct.

The following examples illustrate the preparation of the Diels-Alder adducts and the sulfur-containing compounds derived from the adducts.

Example B-1-E

The adduct of isoprene and methyl acrylate is prepared by mixing 136 parts of isoprene, 172 parts of methyl acrylate, and 0.9 parts of hydroquinone (polymerization inhibitor) in a rocking autoclave and thereafter heating for 16 hours at a temperature within the range of 130°–140° C. The autoclave is vented and the contents decanted thereby producing 240 parts of a light yellow liquid. This liquid is stripped at a temperature of 90° C. and a pressure of 10 millimeters of mercury thereby yielding the desired liquid product as the residue.

To 255 parts (1.65 moles) of the above prepared isoprene-methacrylate adduct heated to a temperature of 110°–120° C., there are added 53 parts (1.65 moles) of sulfur flowers over a 45-minute period. The heating is continued for 4.5 hours at a temperature in the range of 130°–160° C. After cooling to room temperature, the reaction mixture is filtered through a medium sintered glass funnel. The filtrate consists of 301 parts of the desired sulfur-containing product.

EXAMPLE B-1-F

A reaction mixture comprising 1175 parts (6 moles) of the Diels-Alder adduct of butyl acrylate and isoprene and 192 parts (6 moles) of sulfur flowers is heated for 0.5 hour at 108°–110° C. and then to 155°–165° C. for 6 hours while bubbling nitrogen gas through the reaction mixture at 0.25 to 0.5 standard cubic feet per hour. At the end of the heating period, the reaction mixture is allowed to cool and filtered at room temperature. Thereafter, the product is permitted to stand for 24 hours and refiltered. The filtrate is the desired product.

EXAMPLE B-1-G

Sulfur (4.5 moles) and the adduct of isoprene-methyl methacrylate (4.5 moles) are mixed at room temperature and heated for one hour at 110° C. while blowing nitrogen through the reaction mass at 0.25–0.5 standard cubic feet per hour. Subsequently the reaction mixture is raised to a temperature of 150°–155° C. for 6 hours while maintaining the nitrogen blowing. After heating, the reaction mass is permitted to stand for several hours while cooling to room temperature and is thereafter filtered. The filtrate consists of 842 parts of the desired sulfur-containing product.

The sulfurized olefins which are useful in the present invention also may include sulfurized fatty acid esters prepared by reacting sulfur, sulfur monochloride, and/or sulfur dichloride with an unsaturated fatty ester at elevated temperatures. Typical esters include $C_{1-20}$ alkyl esters of $C_{8-24}$ unsaturated fatty acids such as palmitoleic, oleic, ricinoleic, petroselic, linoleic, linolenic, oleostearic, licanic, etc. Saturated fatty acid esters prepared from mixed unsaturated fatty acid esters such as are obtained from animal fats and vegetable oils such as tall oil, linseed oil, olive oil, castor oil, peanut oil, rape oil, fish oil, sperm oil, etc., also are useful. Specific examples of the fatty esters which can be sulfurized include lauryl tallate, methyl oleate, alpha oleate, lauryl oleate, cetyl oleate, cetyl linoleate, lauryl ricinoleate, oleyl linoleate, oleyl stearate and alkyl glycerides.

Another class of sulfurized olefins includes sulfurized aliphatic esters of an olefinic monocarboxylic acid. For example, aliphatic alcohols of from 1 to 30 carbon atoms can be used to esterify monocarboxylic acids such as acrylic acid, methacrylic acid, 2,4-pentadienic acid, etc., or fumaric acid, maleic acid, muconic acid, etc. Sulfurization of these esters is conducted with elemental sulfur, sulfur monochloride and/or sulfur dichloride. The sulfurized olefins useful as component (B-1) in the present invention also may be at least one sulfurized terpene compound or a composition prepared by sulfurizing a mixture comprising at least one terpene and at least one other olefinic compound. The term "terpene compound" as used herein is intended to include the various isomeric terpene hydrocarbons having the empirical formula $$C_{10}H_{16}$$

such as contained in turpentine, pine oil and dipentenes, and the various synthetic and naturally occurring oxygen-containing derivatives. The sulfurized terpene compounds can be prepared by sulfurizing terpene compounds with sulfur, sulfur halides, or mixtures of sulfur or sulfur dioxide with hydrogen sulfide as known in the art. The sulfurization of various terpene compounds has been described in, for example, U.S. Pat. No. 2,012,446, and more recently in U.S. Pat. No. 4,584,113. A disclosure of these patents which relates to the preparation of sulfurized olefins hereby is incorporated by reference.

The following examples illustrate the preparation of sulfurized terpene compounds and sulfurized mixtures of terpenes and olefininc compounds which are useful in the present invention.

EXAMPLE B-1-H

To a reaction vessel there is charged 372 parts (2 equivalents) of a commercially available pine oil (Sargent Welch), and the pine oil is heated and stirred. Sulfur (128 parts) is added slowly with nitrogen blowing while the reaction temperature is maintained at about 35° C. After addition of the sulfur is completed, nitrogen is bubbled through the reaction mixture while it is heated to reflux at about 145° C. After a total reaction time of about 8 hours, the mixture is filtered through filter aid. The filtrate is the desired sulfurized product containing 23.35% sulfur (theory 25.6).

EXAMPLE B-1-I

The procedure of Example B-1-H is repeated except that the reaction mixture comprises 186 parts of pine oil (1 equivalent) and 32 parts of sulfur (1.0 equivalent). The product obtained in this matter has a sulfur content of 15.6% (theory 14.68).

EXAMPLE B-1-J

A mixture of 186 parts (1 equivalent) of pine oil and 168 parts (1 equivalent) of polypropylene is prepared, and 96 parts (3 equivalents) of sulfur are added with stirring. The reaction mixture is heated to a temperature of about 170° C. with nitrogen blowing and maintained at this temperature for 10 hours. The reaction mixture then is cooled and filtered through filter aid. The filtrate is the desired product having a sulfur content of 16.79% (theory 21.33%).

(B-2) Hydroxythioethers

The sulfur-containing compositions useful in the present invention may be hydroxythioethers of the formula $$(HS)_q-R\left[S-\overset{(R')_2}{\overset{|}{C}}_x-(O\overset{(R')_2}{\overset{|}{C}}_y)_z-OH\right]_m \qquad \text{(II)}$$

wherein R is a hydrocarbyl group of up to about 30 carbon atoms and having a valence of m+q; each R′ is independently hydrogen or a hydrocarbyl group of up to about 20 carbon atoms; x and y are each independently an integer of from 2 to about 5; z is an integer of from 0 to about 5; q is an integer of from 0 to about 4; and m is an integer of from 1 to about 5 with the proviso that the sum of m+q is from 1 to 6.

Preferred hydroxythioethers are those compounds of Formula II wherein R is a saturated hydrocarbon containing from about 6 to about 18 carbon atoms; each R' is selected from hydrogen or lower alkyl groups of up to about 7 carbon atoms, more preferably hydrogen, methyl or ethyl; q is 0; m is 1 to 2, more preferably 1; x is 2; y is 2; and z is 0 or 1. Particularly preferred compounds correspond to those which have a hydroxy group which is in the beta position to the divalent sulfur atoms. When q+m is greater than 1, R is preferably a group having no more than two divalent sulfur atoms directly attached to any one carbon atom, and more preferably only one sulfur atom per carbon atom.

Especially preferred hydroxythioethers useful in this invention as (B-2) comprise compounds wherein;

(1) R is a saturated hydrocarbon of from about 6, particularly a saturated aliphatic or alicyclic-substituted aliphatic hydrocarbon, up to about 18 carbon atoms, and more preferably an alkyl of from about 8 to about 16 carbon atoms;

(2) each R' is independently selected from hydrogen and lower alkyl, especially methyl, and ethyl;

(3) x and y are individually 2;

(4) z is either zero or 1, more preferably zero;

(5) m is 1 or 2, more preferably 1; and (6) q is zero.

Examples of these preferred hydroxythioethers include (1) $n\text{-}C_8H_{17}SCH_2CHOHCH_3$ (2) $n\text{-}C_{12}H_{25}SCH_2CHOHCH_3$ (3) $t\text{-}C_{12}H_{25}SCH_2CHOHCH_3$ (4) $n\text{-}C_{10}H_{21}SCH_2CH_2OH$ (5) $t\text{-}C_9H_{19}SCH_2CH(CH_3)OCH_2CHOHCH_3$ (6) $C_{11\text{-}14}H_{23\text{-}29}SCH_2CHOHCH_3$ (i.e., a mixture of hydroxythioethers)

(7) $n\text{-}C_{16}H_{33}SCH_2CHOHCH_3$ (8) $n\text{-}C_{14}H_{29}SCH_2CH_2OH$ (9) $n\text{-}C_{14}H_{29}SCH_2CH_2OCH_2CH_2OH$

(10) $n\text{-}C_{12}H_{25}SCH_2CH_2CH_2OH$

The particular manner in which these hydroxythioethers are prepared is not critical. There are several routes for the preparation of the hydroxythioethers. For example, hydroxythioethers for use in this invention can be formed by the reaction of a monomercaptan compound of the formula $R(SH)_p$ (wherein p is 1) with an epoxide. This reaction can be conducted at temperatures ranging from about 30° C. up to just below the decomposition temperature of the reactants or products and is preferably carried out at from about 40° C. to about 200° C. The use of a catalyst facilitates the reaction, and a basic catalyst (e.g., sodium metal or sodium hydroxide) is usually preferred.

At approximately equimolar amounts of monomercaptan and epoxide and at lower reaction temperatures (e.g., 50° C. to 130° C.) a monocondensation product is favored and conforms for the most part to the formula

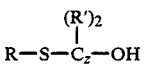

(IIA)

wherein R, R' and x are as above.

Higher reaction temperatures (e.g., 130°-200° C. or higher), and/or molar amounts of epoxide in excess of the molar amount of monomercaptan generally favor formation of compounds conforming for the most part to the formula

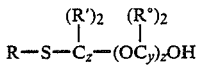

(IIB)

wherein R, R', x, and y are as above-described and z is primarily greater than zero; that is, for the resulting reaction product, the average numerical value of z will be greater than zero although some of the hydroxythioethers in the reaction product can correspond to the above formula where z is zero.

Any unreacted monomercaptan starting material and/or any unreacted epoxide can remain in the final reaction product and be used in total as an additive for the lubricating oil compositions. Normally, epoxides which can be readily removed by distillation will be removed and recovered. It is generally preferred to use at least a stoichiometrically equivalent amount of epoxide so that all the mercapto groups (i.e., —SH) are converted to thioether groups. The equivalent weight of a mercaptan is based on the number of mercapto groups persent. Thus, the equivalent weight of a monomercaptan is its molecular weight; a dimercaptan one-half its molecular weight; a trimercaptan, one-third its molecular weight, etc. The equivalent weight of the epoxides corresponds to their molecular weights. Thus a stoichiometrically equivalent amount of mercaptan and epoxide corresponds to one mole of epoxide for each equivalent weight of mercaptan.

The mercaptans useful in this preparation can be made by the reaction of an olefin with hydrogen sulfide in the presence of a catalyst. Examples of such preparations are in U.S. Pat. Nos. 3,049,567; 2,928,880; 3,005,030; and 3,032,592 which are hereby incorporated by reference for their teaching of the preparation of suitable mercaptans.

The mercaptans useful in this preparation of the hydroxythioethers may be primary, secondary or tertiary mercaptans. Many of these materials are commercially available. Tertiary mercaptans prepared from tri- and tetrapropene and di- and triisobutylene base hydrocarbons are preferred.

Suitable epoxides for use in the above preparation of the hydroxythioethers of this invention include compounds of the formula

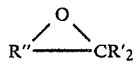

wherein R' is as above-described and

R'' is —Cw(R')2— and w is from 1 to 4, preferably 1 or 2, more preferably 1.

Examples of such epoxides include ethylene oxide, propylene oxide, 1,2-epoxyhexane, 1,2-epoxyhexadecane, 1,3-epoxybutane, 3,5-epoxyheptane, 1,2-epoxycyclohexene, 4,5-epoxydecane; 1,2-epoxy-5-oxy-Heptane; 1,2-epoxy-6-propyltridecane, oxetanes, 9,10-epoxystearic acid esters, styrene oxides, para-chlorostyrene oxide, and mixtures of two or more of these. Generally, any such epoxide which is stable under the reaction conditions employed may be used but the reactivity of terminal epoxides make them more preferred. The terminal lower alkylene oxides are preferred with ethylene oxide and propylene oxide or mixtures thereof being the most preferred epoxides. It should be noted, however, that higher molecular weight eoxides (i.e., $C_{10-20}$ epoxides) are useful for imparting higher levels of oil solubility to the hydroxythioethers, if desired.

The reaction of the epoxide and mercaptan may be carried out in the presence or absence of added solvents or diluents as a reaction media. One convenient method for effecting a reaction is the addition of the epoxide in small amounts to an excess of mercaptan whereby the mercaptan and the resulting hydroxythioether can form the reaction media. If desired, the reaction can be continued until nearly all the mercaptan is reacted. When the reaction is conducted in the presence of an added reaction media, i.e., one or more substantially inert, normally liquid, organic diluents or solvents, the total amount of the diluent or solvent used is not critical. Ordinarily this diluent will comprise about 10% to about 80%, and preferably, about 30% to about 70% by weight of the reaction media based on the total weight of the reactants and reactant media in the reaction mixture. By "substantially inert" is meant a material which does not materially interfere in an adverse manner with the reaction nor react in any significant amount under the conditions of the reaction as described and exemplified herein.

Suitable diluents or solvents include aromatic hydrocarbons, aliphatic hydrocarbons, chlorinated hydrocarbons, ethers, and the like, such as benzene, toluene, xylene, heptane, octane, cyclohexane, methylcyclohexane, kerosene, mineral oil, chlorobenzene, n-propylether, methyl n-amylether, and mixtures of two or more of these. Selection of specific, suitable reaction media is within the skill of the art.

The reaction is conveniently conducted at atmospheric pressure, but it also may be conducted at subatmospheric or superatmospheric pressure, if desired. After the reaction is complete, the desired product can be separated, if desired, from the reaction mass by techniques shown in the art. Most solids present are normally removed by filtration. A convenient separation technique utilizes a diatomaceous earth filter aid. Generally, it is not necessary to remove all the catalyst or reaction by-products especially when these materials are at low levels (e.g., 0.1% by weight).

As in the above monomercaptan epoxide reactions, polymercaptans of the formula $R(SH)_p$ wherein p is from 2 to 6, preferably 2 to 4, more preferably 2) can be reacted with epoxides to form compounds conforming for the most part of the formula $$(HS)_q-R\left[S-\overset{(R')_2}{\overset{|}{C}}_x-(O\overset{(R')_2}{\overset{|}{C}}_y)_z-OH\right]_m \quad \text{(II)}$$

wherein q is p—m and can be from 0 to 4; m can vary up to 6 and usually is equal to p (preferably p and m are 2 and q is zero when polymercaptans are used); and R, R', x, y and z are as above-described.

Examples of polymercaptans include decamethylenedithiol; 2,6-dimethyloctanedithiol; octadecamethylenedithiol; 2,7-naphthalenedithiol and neopentanetetrathiol. Other useful polymercaptans may be found in the test ORGANIC CHEMISTRY OF BIVALENT SULFUR, Volume I, by E. E. Reid, 1958, published by Chemical Publishing Co., Inc. which is expressly incorporated herein by reference for its disclosures of suitable polymercaptans.

Procedures for the preparation of hydroxythioethers useful in this invention can be found in ORGANIC CHEMISTRY OF BIVALENT SULFUR, Volume II, by E. E. Reid, 1960, published by Chemical Publishing Co., Inc., which is incorporated herein by reference for its relevant disclosure of the preparation of hydroxythioethers from such unsaturates and mercapto alcohols.

The following examples illustrate the preparation of hydroxythioethers useful as component (B-2) in the present invention.

EXAMPLE B-2-A

While allowing the temperature to increase from 40° C. to 135° C., a reaction mixture is prepared by the addition of 580 parts (10 moles) of propylene oxide to 2020 parts (10 moles) of tertiary dodecyl mercaptan and 14 parts of a 50% aqueous solution of sodium hydroxide. The reaction mixture is refluxed at 115°–120° C. for 3 hours, stripped to 120° C. under vacuum and filtered. The filtrate (2597 parts) is the desired hydroxytioether which is primarily the mono-condensation product of the mercaptan and propylene oxide.

EXAMPLE B-2-B

At 100° C., a reaction mixture is prepared by the addition of 1200 parts of styrene oxide to 2020 parts of tertiary dodecyl mercaptan and 14 parts of a 50% aqueous solution of sodium hydroxide. The reaction mixture is stripped to 195° C. under vacuum and filtered to yield, as the filtrate, the desired hydroxythioether which is primarily the mono-condensation product of the mercaptan and styrene oxide.

EXAMPLE B-2-C

A mixture of 1047 parts of n-dodecyl mercaptan and 0.8 part of sodium metal is heated to 120° C. At 120°–145° C., 305 parts of propylene oxide is added over 2.5 hours. The reaction mixture is stripped to 120° C. under vacuum and filtered to yield, as the filtrate, the desired hydroxythioether which is primarily the mono-condensation product of the mercaptan and propylene oxide.

EXAMPLE B-2-D

While maintaining the temperature at 119°–150° C., a mixture is prepared by bubbline ethylene oxide through 545 parts of tertiary dodecyl mercaptan and 2.4 parts of sodium hydroxide until a weight gain of 265 parts is obtained. The mixture is held at 150°–160° C. under nitrogen for one hour and filtered to yield primarily the desired condensation product of the mercaptan and 2 moles of ethylene oxide as filtrate.

EXAMPLE B-2-E

At 70°–85° C., a mixture is prepared by the addition of 58 parts of propylene oxide to 167 parts of polybutene (number average molecular weight is 300 by vapor phase osmometry) mercaptan and 1.5 parts of sodium methoxide. The reaction mixture is heated at 85°–90° C. under nitrogen, then stripped to 100° C. under vacuum, filtered, to yield primarily, as the filtrate, the desired hydroxythioether formed from 2 moles of propylene oxide and 1 mole of a mercaptan.

EXAMPLE B-2-F

A mixture of 350 parts of decene-1 and 195 parts of 2-mercaptoethanol is stirred at 40°-60° C. for 3 hours. The reaction mixture is stripped to 100° C. under vacuum and filtered. The filtrate is primarily the desired hydroxythioether; it contains 13.79% sulfur.

(B-3) Nitrogen- and Sulfur-Containing Compositions

The compositions of the present invention also may contain at least one nitrogen- and sulfur-containing composition obtained by the reaction of at least one amino compound, carbon disulfide and either hydrocarbon-substituted carboxylic acids or halogenated aliphatic hydrocarbons.

The compositions which are based upon the carboxylic acids may be prepared by reacting about 1 mole of an alkylene amine with at least about 0.5 equivalent of carbon disulfide and at least about 1 equivalent of a substantially hydrocarbon-substituted dicarboxylic acid, and removing the water formed by the reaction. The process can be carried out by mixing the reactants in any order. All three reactants may be mixed at room temperature and heated to a temperature above about 80° C. to effect acylation. The reaction may likewise be carried out by first reacting the amine with carbon disulfide and then acylating the intermediate product with a dicarboxylic acid, or by acylating the amine with the dicarboxylic acid and then reacting the acylated amine with carbon disulfide. The last mentioned mode of carrying out the process is preferred because the products obtained have been found to be especially useful for the purpose of this invention. As noted, the reaction generally is conducted at a temperature of above about 80° C. and more generally between about 150° C. and 250° C. The preparation of these nitrogen- and sulfur-containing compositions based upon carboxylic acids is described in more detail in U.S. Pat. Nos. 3,200,107 and 3,256,185, the disclosure of which are hereby incorporated by reference.

In general, a convenient route for the preparation of the nitrogen- and sulfur-containing composition (B-3) comprises the reaction of a hydrocarbon-substituted succinic acid-producing compound ("carboxylic acid acylating agent") with an amine containing at least one hydrogen attached to a nitrogen atom (i.e., H-N<). The hydrocarbon-substituted succininc acid-producing compounds include the succinic acids, anhydrides, halides and esters. The number of carbon atoms in the hydrocarbon substitutent on the succinic acid-producing compound may vary over a wide range provided that the nitrogen-containing composition is soluble in the lubricating compositions of the present invention. Thus, the hydrocarbon substituent generally will contain an average of at least about 30 aliphatic carbon atoms and preferably will contain an average of at least about 50 aliphatic carbon atoms. In addition to the oil-solubility considerations, the lower limit on the average number of carbon atoms in the substituent also is based upon the effectiveness of such compounds in the lubricating oil compositions of the present invention. The hydrocarbyl substituent of the succinic compound may contain polar groups as indicated above, and, providing that the polar groups are not present in proportion sufficiently large to significantly alter the hydrocarbon character of the substituent.

The sources of the substantially hydrocarbon substituent include principally the high molecular weight substantially saturated petroleum fractions and substantially saturated olefin polymers, particularly polymers of mono-olefins having from 2 to 30 carbon atoms. The especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. They are illustrated by 2-butene, 2-pentene, and 4-octene.

Also useful are the interpolymers of the olefins such as those illustrated above with other interpolymerizable olefinic substances such as aromatic olefins, cyclic olefins, and polyolefins. Such interpolymers include, for example, those prepared by polymerizing isobutene with styrene; isobutene with butadiene; propene with isoprene; ethylene with piperylene; isobutene with chloroprene; isobutene with p-methyl styrene; 1-hexene with 1,3-hexadiene; 1-octene with 1-hexene; 1-heptene with 1-pentene; 3-methyl-1-butene with 1-octene; 3,3-dimethyl-1-pentene with 1-hexene; isobutene with styrene and piperylene; etc.

Another source of the substantially hydrocarbon group comprises saturated aliphatic hydrocarbons such as highly refined high molecular weight white oils or synthetic alkanes such as are obtained by hydrogenation of high molecular weight olefin polymers illustrated above or high molecular weight olefinic substances.

The use of olefin polymers having molecular weights (Mn) of about 700–10,000 is preferred. Higher molecular weight olefin polymers having molecular weights (Mn) from about 10,000 to about 100,000 or higher have been found to impart also viscosity index improving properties to the final products of this invention. The use of such higher molecular weight olefin polymers often is desirable. Preferably the substituent is derived from a polyolefin characterized by an Mn value of about 700 to about 10,000, and an Mw/Mn value of 1.0 to about 4.0.

In preparing the substituted succinic acylating agents of this invention, one or more of the above-described polyalkenes is reacted with one or more acidic reactants selected from the group consisting of maleic or fumaric reactants such as acids or anhydrides. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acid-producing compounds useful in the present invention. The especially preferred reactants are maleic acid, maleic anhydride, and mixtures of these. Due to availability and ease of reaction, maleic anhydride will usually be employed.

For convenience and brevity, the term "maleic reactant" is often used hereinafter. When used, it should be understood that the term is generic to acidic reactants selected from maleic and fumaric reactants including a mixture of such reactants. Also, the term "succinic acylating agents" is used herein to represent the substituted succinic acid-producing compounds. One procedure for preparing the substituted succinic acylating agents useful in this invention is illustrated, in part, in U.S. Pat. No. 3,219,666 which is expressly incorporated herein by reference for its teachings in regard to preparing succinic acylating agents.

Another procedure for preparing substituted succinic acid acylating agents useful in this invention utilizes a process described in U.S. Pat. No. 3,912,764 and U.K. Pat. No. 1,440,219, both of which are expressly incorporated herein by reference for their teachings in regard to that process. Yet another process for preparing the substituted succinic acylating agents of this invention is the so-called "one-step" process. This process is described in U.S. Pat. Nos. 3,215,707 and 3,231,587. Both are expressly incorporated herein by reference for their teachings in regard to that process.

The amines which are reacted with the succinic acid-producing compounds to form the nitrogen-containing compositions may be monoamines and polyamines. The monoamines and polyamines must be characterized by the presence within their structure of at least one H-H< group. Therefore, they have at least one primary (i.e., $H_2N$—) or secondary amino (i.e., 1 H-N<) group. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as —$CH_2CH_2$—X—$CH_2CH_2$— where X is —O— or —S—). In general, the amine of (B) may be characterized by the formula $$R_1R_2NH$$

wherein $R_1$ and $R_2$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl and acylimidoyl groups provided that only one of $R_1$ and $R_2$ may be hydrogen.

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and dialkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl)amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic ring, especially those derived from naphthalene. Examples of aromatic monoamines include aniline, di(para-methylphenyl)amine, naphthylamine, N-(n-butyl)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

The polyamines include principally alkylene amines conforming for the most part to the formula $$A-\underset{\underset{A}{|}}{N}-(\text{alkylene}-\underset{\underset{A}{|}}{N})_n-H$$

wherein n is an integer preferably less than about 10, A is a hydrogen group or a substantially hydrocarbon group preferably having up to about 30 carbon atoms, and the alkylene group is preferably a lower alkylene group having less than about 8 carbon atoms. The alkylene amines include principally methylene amines, ethylene amines, butylene amines, propylene amines, pentylene amines, hexylene amines, heptylene amines, octylene amines, other polymethylene amines. They are exemplified specifically by: ethylene diamine, triethylene tetramine, propylene diamine, decamethylene diamine, octamethylene diamine, di(heptamethylene)triamine, tripropylene tetramine, tetraethylene pentamine, trimethylene diamine, pentaethylene hexamine, di(trimethylene)triamine. Higher homologues such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk and Othmer, Vol. 5, pp. 898–905, Interscience Publishers, New York (1950). Such compounds are prepared most conveniently by the reaction of an alkylene chloride with ammonia. The reaction results in the production of somewhat complex mixtures of alkylene amines, including cyclic condensation products such as piperazines. These mixtures find use in the process of this invention. On the other hand, quite satisfactory products may be obtained also by the use of pure alkylene amines. An especially useful alkylene amine for reasons of economy as well as effectiveness of the products derived therefrom is a mixture of ethylene amines prepared by the reaction of ethylene chloride and ammonia and having a composition which corresponds to that of tetraethylene pentamine.

Hydroxyalkyl-substituted alkylene amines, i.e., alkylene amines having one or more hydroxyalkyl substituents on the nitrogen atoms, likewise are contemplated for use herein. Higher homologues such as are obtained by condensation of the above illustrated alkylene amines or hydroxy alkyl-substituted alkylene amines through amino radicals or through hydroxy radicals are likewise useful. It will be appreciated that condensation through amino radicals results in a higher amine accompanied with removal of ammonia and that condensation through the hydroxy radicals results in products containing ether linkages accompanied with removal of water.

Additional details and examples of the procedures for preparing the nitrogen-containing compositions useful in the present invention by reaction of succinic acid-producing compounds and amines are included in, for example, U.S. Pat. Nos. 3,172,892; 3,219,666; 3,272,746; and 4,234,435, the disclosures of which are hereby incorporated by reference.

The relative proportions of the reactants used in the preparation of the sulfur- and nitrogen-containing compositions (B-3) are based upon the stoichiometry of the reaction involved in the process. The minimum amounts of the dicarboxylic acid and the carbon disulfide to be used are one equivalent of the dicarboxylic acid (one mole contains two equivalents) and about 0.5 equivalent of the carbon disulfide (one mole contains two equivalents) for each mole of the amine used. The maximum amounts of these two reactants to be used are based upon the total number of equivalents of the alkylene amine used. In this respect, it will be noted that one mole of the alkylene amine contains as many equivalents as there are nitrogen atoms in the molecule. Thus, the maximum combined equivalents of dicarboxylic acid in carbon disulfide which can react with one mole of alkylene amine is equal to the number of nitrogen atoms in the alkylene amine molecule. It has been found that the products having particularly usefulness in the present invention are those obtained by the use of dicarboxylic acid and carbon disulfide in relative amounts within the limits of ratio of equivalents of from about 1:3 to about 3:1. A specific example illustrating the limits of the relative proportions of the reactants is as follows: one mole of a tetraalkylene pentamine is reacted with from 1 to 4.5 equivalents, preferably from about 1 to 3 equivalents, of dicarboxylic acid and from about 0.5 to 4 equivalents, preferably from 1 to 3 equivalents, of carbon disulfide.

The following examples are illustrative of the process for preparing the nitrogen- and sulfur-containing compositions (B-3) useful in this invention:

EXAMPLE B-3-A

To a mixture of 1750 parts of a mineral oil and 3500 parts (6.5 equivalents) of a polyisobutene-substituted succinic anhydride having an acid number of 104 prepared by the reaction of maleic anhydride with a chlorinated polyisobutene having a molecular weight of 1000 and a chlorine content of 4.5%, there is added at 70°-100° C., 946 parts (25.9 equivalents) of triethylene tetramine. The reaction is exothermic. The mixture is heated at 160°-170° C. for 12 hours while nitrogen is passed through the mixture, whereupon 59 cc. of water is collected as the distillate. The mixture is diluted with 1165 parts of mineral oil and filtered. The filtrate is found to have a nitrogen content of 4.12%. To 6000 parts of the above acylated product, there is added 608 parts (16 equivalents) of carbon disulfide at 25°-50° C. throughout a period of 2 hours. The mixture is heated at 60°-73° C. for 3 hours and then at 68°-85° C./7 mm. Hg. for 5.5 hours. The residue is filtered at 85° C. and the filtrate is found to have a nitrogen content of 4.45% and a sulfur content of 4.8%.

EXAMPLE B-3-B

The product of Example B-3-A is heated at 150°-180° C. for 4.5 hours and filtered. The filtrate is found to have a nitrogen content of 3.48% and a sulfur content of 2.48%.

EXAMPLE B-3-C

An alkylene amine mixture consisting of 34% (by weight) of a commercial ethylene amine mixture having an average composition corresponding to that of tetraethylene pentamine, e.g., 8% of diethylene triamine, and 24% of triethylamine tetramine (459 parts, 11.2 equivalents) is added to 4000 parts (7.4 equivalents) of the polyisobutene-substituted succinic anhydride for Example B-3-A and 2000 parts of mineral oil at 61°-88° C. The mixture is heated at 150°-160° C. for 6 hours while being purged with nitrogen. A total of 75 cc. of water is collected as the distillate during the period. The residue is diluted with 913 parts of mineral oil, heated to 160° C. and filtered. The filtrate is found to have a nitrogen content of 2.15%. To 6834 parts of the above filtrate there is added 133 parts (3.5 equivalents) of carbon disulfide at 22°-30° C. throughout a period of 1 hour. The mixture is heated at 50°-72° C. for 2.5 hours and then to 90° C./15 mm. The residue is found to have a nitrogen content of 2.13% and a sulfur content of 1.41%.

EXAMPLE B-3-D

The product of Example B-3-C is heated at 120°-160° C. for 4 hours and filtered. The filtrate is found to have a nitrogen content of 2.14% and a sulfur content of 0.89%.

EXAMPLE B-3-E

A mixture of 508 parts (12 equivalents) of Polyamine H and 152 parts (4 equivalents) of carbon disulfide is prepared at 25°-60° C., heated to 190° C. in 3 hours and at 190°-210° C. for 10 hours. The mixture is then purged with nitrogen at 200° C. for 1 hour. The residue is found to have a nitrogen content of 29.7% and a sulfur content of 6.5%. The above product (95 parts) is added to a solution of 1088 parts (2 equivalents) of the polyisobutene-substituted succinic anhydride of Example B-3-A in 600 cc. of toluene at 70°-80° C. in 10 minutes. The mixture is heated at 127° C. for 8 hours whereupon 10.6 cc. of water is removed by azeotropic distillation with toluene. The residue is heated at 150° C. to remove toluene, diluted with 783 parts of mineral oil and heated again to 152° C./13 mm. The residue is found to have a nitrogen content of 1.48% and a sulfur content of 0.43%.

The nitrogen- and sulfur-containing composition (B-3) also may be a composition obtained by reacting an amino compound, carbon disulfide, and a halogenated aliphatic hydrocarbon containing at least about 25 carbon atoms. The amino compounds may be selected from the group consisting of amines, hydroxyamines, heterocyclicamines, polyamines, hydrazine, organically-substituted hydrazines and ammonia. Any of the amino compounds described above with respect to the reaction of the carboxylic acids in the preparation of nitrogen- and sulfur-containing compositions may be utilized in the reaction with the halogenated aliphatic hydrocarbon.

In addition to carbon disulfide itself, compounds which generate carbon disulfide under the reaction conditions can also be used. Such compounds include, for example, metal tri-thiocarbonate salts, xanthates, low molecular weight dithiocarbamates, etc.

The halogenated aliphatic hydrocarbon generally contain at least 25 carbon atoms. While pure halogenated hydrocarbons such as 3-bromo triacontane, 6-chlorotetracontane, 3-iodo-dotetracontane, etc., or mixtures thereof, can be used, it is often preferred to use halogenated derivatives of olefinic polymers. These halogenated derivatives range in number average molecular weight from about 400 to about 100,000 (still higher molecular weight derivatives may be useful and actually preferred when it is desired that the product have viscosity-improving properties). Especially useful are derivatives having number average molecular weights ranging from about 700 to about 5000, such as number average molecular weights of 600, 800, 1900, 2500, 3000, etc. These derivatives contain on the average at least one atom of halogen per molecule of hydrocarbon up to an average of about 1 atom of halogen per 25 carbon atoms in said hydrocarbon molecule. Thus, for example, a chlorinated derivative of a polymer of molecular weight 1000 would contain at least about 35.5 grams of chlorine per 1035.5 grams of chlorinated derivative. While chlorinated, brominated and iodidated hydrocarbons are useful in this invention, chlorinated and brominated hydrocarbons are particularly preferred.

The preferred olefin polymers from which the afore-described halogenated derivatives are obtained are polymers of an alkene or mixtures of alkenes, such as monoolefins having 2 to 20 carbon atoms; particularly preferred are homo- and interpolymers of 1-olefins having about 2 to about 6 carbon atoms such as ethylene, propylene, 1-butene, isobutene, 1-pentene, and 1-hexene. Nevertheless, polymers of 1-octene, 2-methyl-1-heptene, 3-cyclohexyl-1-butene, and 2-methyl-5-propyl-1-hexene can also be used as well as polymers of medial olefins of 2 to 20, preferably 2 to 6 carbons, i.e., olefins in which the olefinic linkage is not in the terminal position, such as 2-butene, 3-pentene and 4-octene.

As noted above, interpolymers of the afore-described olefins can also be used as source materials for the halogenated aliphatic hydrocarbons of the present invention. Such interpolymers include, for example, those prepared by polymerizing isobutene with ethylene; propylene with isoprene; ethylene and piperylene; hexene with 1,3-hexadiene; 1-octene with 1-hexene; 1-heptene with 1-pentene; 3-methyl-1-butene with 1-octene; 3,3-dimethyl-1-pentene with 1-hexene; isobutene with both propene and ethylene, etc.

The halogenated hydrocarbons used in this invention are conveniently prepared by treating suitable hydrocarbons, such as polymers described above, with a halogenating agent such as chlorine, bromine, N-bromosuccinimide, N-iodo-phthalimide, etc. Such techniques are well-known to those skilled in the art. For example, the treatment can be carried out simply by contacting the hydrocarbon with the halogenating agent at a temperature from about 50° C., preferably from about 80° C., up to any temperature below the decomposition point of the reaction mixture. Usually such halogenations are carried out between 80° C. and 250° C., the exact temperature being determined by the precise nature of the halogenating agent and hydrocarbon to be halogenated. The relative amounts of hydrocarbon and halogenated agent used in the reaction are such as to provide incorporation of an average of at least about one atomic proportion of halogen per hydrocarbon molecule and up to about one atomic proportion of halogen per 25 aliphatic carbon atoms in the hydrocarbon molecules. Such amounts, in most instances, are about 1 mole of the hydrocarbon and at least about 1 mole of the halogenating agent.

Halogenated hydrocarbons useful in the present invention contain an average of at least 1 and often 2 or more, such as 10, atomic proportions of halogen per hydrocarbon molecule, especially in instances where the hydrocarbon is of relatively high molecular weight such as 1000 or higher. In most instances, the halogen contents of such halogenated hydrocarbons are between about 0.1% and 15%, preferably between about 2% and about 9% of the total weight of the halogenated hydrocarbon. To form the more highly halogenated polymers, of course, two or more moles of the halogenating agent are used for each mole of polymer to be halogenated. As noted above, the halogenated hydrocarbons contains a maximum of about one halogen atom per 25 carbon atoms.

The halogenation can be carried out in the presence of a substantially inert solvent or diluent such as carbon tetrachloride, chloroform, chlorobenzene, benzene, etc. The reaction is often accompanied by the formation of hydrogen halide which may simply be allowed to escape from the reaction mixture as the treatment proceeds. The precise chemical composition of the halogenated polymer is not always known; it is known, however, that such product does, on the average, contain about one or more halogen substituents per molecule.

In this embodiment, the amino compound, carbon disulfide and halogenated hydrocarbon are contacted at a temperature of at least about 0° C. up to the decomposition point of the reaction mixture. Preferably, the reaction is carried out between about 0° C. and about 250° C., and most preferably between 75°–150° C. The reaction normally is carried out over a period of about 0.1 to about 48, and preferably from 1 to about 10 hours.

Although the reactants may be reacted in various proportions, from about 0.5 to about 6, preferably from about 1 to about 5 equivalents of amine are reacted with 0.5 to about 5, preferably 1 to about 3 equivalents of carbon disulfide and 1 equivalent of halogenated hydrocarbon. Hydrogen halide acceptors may be included in the reaction mixture. Examples of hydrogen halide acceptors include carbonates, bicarbonates, oxides, hydroxides, amines, etc.

The order in which the reactants are reacted with each other is not critical, and thus, the amino compound may be reacted with the carbon disulfide and then with the halogenated hydrocarbon. Alternatively, the amino compound can be reacted with the aliphatic hydrocarbon and then with carbon disulfide. Preferably, however, the amino compound is reacted with the halogenated hydrocarbon to form an intermediate which is then reacted with carbon disulfide.

The production of such intermediates from reactants such as amino compounds and halogenated hydrocarbons is described in, for example, U.S. Pat. Nos.

3,454,555 and 3,438,757 which are hereby incorporated by reference for their relevant disclosures.

Generally, the final products are obtained by simply adding carbon disulfide or suitable substitute therefor to the amino intermediate in the presence or absence of an inert solvent/diluent. Generally, these reactants are mixed in a ratio of about 0.5 to about 6.0, preferably about 1 to about 3 equivalents of amino intermediate per equivalent of $CS_2$. Suitable substantially inert solvents or diluents for this reaction include such relatively low boiling solvents as pentane, heptane, benzene, toluene, xylene, etc., as well as high boiling materials such as solvent neutral oil, bright stock and various types of lubricating oil base stocks well known to those of skill in the art. The product can be recovered from such solvents or diluents by such standard procedures as distillation, evaporation, precipitation, etc., when desired. Alternatively, if the solvent or diluent is, for example, a lubricating base oil, the product can be left in the solvent or diluent and used to form a lubricating or fuel oil composition as described below.

The following examples illustrate the preparation of these types of compositions.

EXAMPLE B-3-F (A) A mixture of 176 parts of polyisobutenyl chloride (containing 4.28% chlorine), 15.36 parts of a commercial mixture of polyethylene polyamines having a nitrogen content of 34% and corresponding in elemental composition to tetraethylene pentamine, and 507 parts of normal octyl alcohol is placed in a three-necked three-liter flask equipped with a stirrer, thermometer and reflux condenser. The mixture is heated for 16 hours at 128°-138° C. and then for an additional 4 hours at 158°-230° C. The mixture is decanted from solids and aliphatic petroleum naphtha (433 parts) is added to it. The mixture is then stripped to 220° C./13 mm to yield 1047 parts of distillate solvent. After addition of another 597 parts of naphtha to the residue, it is extracted with a mixture of distilled water (487 parts) and 50% aqueous sodium hydroxide (700 parts). The organic layer is extracted three times more with approximately 600 parts of 50% aqueous sodium hydroxide each time. It is then washed with a mixture of 705 parts of water and 273 parts isopropyl alcohol. Washing with a water-isopropyl alcohol mixture is repeated twice more. The aqueous layer from the first extraction is back-extracted with naphtha (518 parts) and the naphtha combined with the other organic extracts. This is distilled at 58°-112° C. until 1858 parts of distillate is collected. Toluene is then added (392 parts) and the mixture stripped to 150°-165° C./10-0.5 mm. The residual organic material is filtered through siliceous filter aid to yield, as a producst, a filtrate which is characterized by a nitrogen content of 4.4%.

(B) A mixture of 191 parts of the product of B-3-F(A) and 90 parts of benzene is stirred vigorously at room temperature while 76 parts of carbon disulfide is added dropwise to it over a period of 0.25 hour. The mixture is then stirred for an additional 3 hours at 60°-70° C. and finally stripped to 82° C./5 mm Hg. Eighty parts of a diluent mineral oil is added, and the mixture filtered through filter aid to yield the final product in an oil solution having a nitrogen content of 2.92% and a sulfur content of 1.24%.

EXAMPLE B-3-G

Carbon disulfide (76 parts) is added dropwise at 50° C. to a mixture of 157 parts of diamylamine, a 20% aqueous solution containing 41 grams of sodium hydroxide, and 782 parts of dimethylformamide. The mixture is then heated at 50°-60° C. for 2 hours, after which time 782 parts (0.945 mole) of polyisobutenyl chloride (Mn 830, 4.3% chlorine) is added. Reaction is heated for 12 hours at 80°-90° C., and finally the volatile material is removed from it by vacuum distillation. The residue is dissolved in benzene, filtered and the benzene removed by vacuum distillation, yielding the desired product as a residue containing 1.41% nitrogen and 5.92% sulfur.

EXAMPLE B-3-H (A) Polyisobutenyl chloride having a chlorine content of 5.64% is prepared by passing 910 parts of chlorine gas at a rate of 8 CFH for a total of 18 hours through 7057 parts of polyisobutene at room temperature. The desired halogenated hydrocarbon is obtained by blowing the chlorinated reaction mixture with nitrogen for 2 hours.

(B) A mixture of 3990 parts of the polyisobutenyl chloride described in B-3-H(A), 618 parts of a diethylene triamine, 264 parts of sodium hydroxide, 500 parts of water, 50 parts of potassium iodide, 1000 parts of isopropyl alcohol and 1000 parts of xylene is heated at 85°-90° C. for 3 hours. The mixture is then stripped to 170° C./15 mm and filtered through filter aid to yield as a filtrate the desired amino intermediate which has a nitrogen content of 2.30%.

(C) A mixture of 684 parts of the amino intermediate described in B-3-H(B) and 506 parts of diluent oil is heated to 60° C.; then 76 parts of carbon disulfide is slowly added to it over 1 hour. Heating is continued at 150° C. for 4 hours. Filtration at 150° C. through filter aid yields a solution of the desired product as a filtrate having a sulfur content of 1.58% and a nitrogen content of 1.2%.

EXAMPLE B-3-I

A mixture of 845 parts of the polyisobutenyl chloride described in B-3-F(A) and 232 parts of a commercial mixture of ethylene polyamines corresponding in stoichiometry to pentaethylene hexamine is heated for 4 hours at 200°-215° C. Then 40 parts of powdered sodium hydroxide is added to the mixture at 115° C.; the mixture is then stirred at 115°-130° C. for 1125 hours. Filtration through 3% filter aid provides a filtrate which is taken up in 1000 parts of toluene. Carbon disulfide (76 parts) is added to the toluene mixture at 35° C. The mixture is then heated at reflux for 4 hours and stripped to 205° C./22 mm. The residue is filtered twice through filter aid to provide as the filtrate the desired product which has a nitrogen content of 6.22% and a sulfur content of 2.89%.

(B-4) Sulfurized and/or Carbon Disulfide Reacted Mannich Condensation Products

The sulfur-containing composition present in the compositions of the present invention may also be sulfurized Mannich condensation products and/or carbon disulfide reacted Mannich condensation products. Such products are known in the art and are described in, for example, U.S. Pat. Nos. 3,600,372 and 4,161,475 which are hereby incorporated by reference for their disclosures regarding the preparation of such products.

The Mannich condensation products which may be reacted with carbon disulfide, or a mixture of carbon disulfide and an alkali metal hydroxide may be either of two types of Mannich products. The first type (Type I) Mannich product is formed by the condensation of an alkyl-substituted phenol, an alkylene polyamine and formaldehyde. The second type (Type II) Mannich product is formed by the condensation of an alkyl-substituted phenol, an alkylene polyamine, and a hydrocarbon-substituted aliphatic dicarboxylic acid or anhydride of such acid. Both types of Mannich products can react with carbon disulfide or carbon disulfide and alkali metal hydroxide to produce products which are excellent dispersants, particularly in combination with the novel phosphite esters of the present invention.

The amounts of reactants may vary, but in general, about 0.25 to about 3 moles of carbon disulfide are reacted with about 1 equivalent of the Mannich product (1 equivalent of the Mannich product being the molecular weight of the Mannich product divided by the number of reactive nitrogen atoms present per molecule). When a mixture of carbon disulfide and the alkali metal hydroxide are used, the ratio by weight of carbon disulfide to the hydroxide will range from about 2:1 to 1:2. Preferably, the ratio is 1:1. Although saturated aqueous solutions of the hydroxides may be used, the 25% by weight alkali metal hydroxide solution also performs satisfactorily.

Generally, the hydroxide is first blended with the Mannich product and then the carbon disulfide is added to the blend. Examples of suitable alkali metal hydroxides include potassium hydroxide, sodium hydroxide and lithium hydroxide.

In preparing Type I Mannich products, about 2 moles of a substituted phenol are reacted with about 3 moles of formaldehyde and about 2 moles of an alkylene polyamine. In preparing Type II Mannich products, about 1 mole of a substituted phenol is reacted with about 2 moles of formaldehyde and about 2 moles of an alkylene polyamine to produce an intermediate, and about 1 mole of this intermediate is then reacted with about 2 moles of an aliphatic dicarboxylic acid or acid anhydride.

Examples of suitable alkyl-substituted phenols are polybutyl and polypropyl para-substituted phenols whose substituent groups are, respectively, derived from polybutenes and polypropenes. The preferred alkyl substituent contains from about 2 to 20,000 carbon atoms. In preparing Type I Mannich products, the phenolic compounds wherein the alkyl substituent is a polybutyl radical are preferred. In preparing Type II Mannich products, phenolic compounds wherein the alkyl substituent is a nonyl radical are preferred.

Suitable alkylene polyamines generally come within the following formula $$H_2N(\text{—alkylene—}NH)_nH$$

in which n is an integer from about 1 to 12. The preferred alkylene polyamine is tetraethylene pentamine. Other alkylene polyamines include, for example, propylene amines, butylene amines, trimethylene amines, tetramethylene amines, and also cyclic homologues of such polyamines, for example, piperazines. Specific examples are: ethylene diamine, diethylene triamine, triethylene tetramine, propylene diamine, tripropylene tetramine, trimethylene diamine, pentaethylene tetramine, di(trimethylene)triamine, N-2-aminoethyl-piperazine, and octamethylene diamine.

Examples of suitable acids and acid anhydrides are hydrocarbon-substituted succinic, malonic, glutaric, and adipic acids and anhydrides thereof. The hydrocarbon substituent should impart oil solubility to the acid or anhydride. Generally, hydrocarbon substituents having about 10 or more carbon atoms work well. Hydrocarbon substituents of the acids or anhydrides may be prepared using olefin polymers having a molecular weight between about 500 to 100,000, and they may also contain other groups, as for example, chloro, bromo, nitro, alkoxy, or phenoxy radicals.

For a more detailed description of the Type I and Type II Mannich products, refer to, respectively, U.S. application Ser. No. 502,368, filed Oct. 22, 1965, and U.S. application Ser. No. 591,084, filed Nov. 1, 1966. The disclosures of these patents are hereby incorporated by reference.

The following examples illustrate the preparation of useful Mannich derivatives.

EXAMPLE B-4-A

A Type I Mannich product is first prepared by reacting about 2 moles of a polybutyl-substituted phenol having a molecular weight of about 2000 with about 3 moles of formaldehyde and about 2 moles of tetraethylene pentamine. The reaction is conducted in an SAE 5 oil, and the Mannich product constitutes 50% by weight of the resulting oil blend. Over a period of 10 minutes, 24 milliliters of carbon disulfide (0.4 mole) are added dropwise with stirring to 500 grams (0.4 eq.) of this blend. During the addition of the carbon disulfide to the blend, the temperature rises to about 40° C. For two hours following the addition of the carbon disulfide, the mixture is stirred and gradually heated to about 150° C., during which time hydrogen sulfide evolves. The product is then cooled to about room temperature.

EXAMPLE B-4-B

A Type II Mannich product is first prepared by reacting about 1 mole of nonylphenol with about 2 moles of tetraethylene pentamine and about 2 moles of formaldehyde to form an intermediate with about 2 moles of polybutenyl succinic anhydride. The reaction is conducted in an SAE 5 oil, and the Mannich product constitutes 50% by weight of the resulting oil blend. Over a period of about 20 minutes, 18 milliliters of carbon disulfide (0.3 mole) are added dropwise with stirring to 400 grams (0.6 eq.) of this blend. During the addition of the carbon disulfide to the blend, the temperature rises to about 40° C. For two hours following the addition of the carbon disulfide, the mixture is stirred and gradually heated to about 150° C., curing which time hydrogen sulfide evolves. The product is then allowed to cool to about room temperature. A bomb sulfur analysis of the product shows the presence of sulfur in the amount of 1.88% by weight.

EXAMPLE B-4-C

A Type II Mannich product is prepared as described in Example B-4-B. Then, 140 grams of a 50% by weight potassium hydroxide aqueous solution are added to 1000 grams of this Mannich product. Over a period of about 30 minutes, 76 milliliters of carbon disulfide are added dropwise with stirring to the mixture of potassium hydroxide and the Mannich product. During the addition and mixing of the above reactions, the temperature rises to about 40° C. About 500 milliliters of benzene are also introduced into the mixture to reduce viscosity. The mixture is stirred overnight and allowed to cool to room temperature.

Sulfurized Mannich products useful as component (B-4) can be prepared by reacting elemental sulfur with the nitrogen-containing Mannich products of the type described above. Generally, from about 0.1 to about 20% by weight of sulfur can be incorporated into the Mannich products.

The form of elemental sulfur used in preparing the sulfurized Mannich products used in the present invention is not critical. Thus, amorphous for crystalline sulfur in its various forms can be used. The sulfurization reaction is carried out until a minimum of about 0.1% sulfur is incorporated into the Mannich product. Generally, this will be accomplished in a reaction time of from about 0.25 to about 24 hours. The rate of sulfur incorporation will vary with the reaction temperature, and temperatures within a range of from about 75° C. to about 300° C. normally are employed. Preferably the minimum reaction temperature will be about 150° C., and the maximum about 250° C.

The sulfurization reaction can be carried out by merely mixing the elemental sulfur and the Mannich product in the absence of other materials. Preferably, however, the reaction is carried out in the presence of an inert liquid solvent/diluent which can be an oil or a lower molecular weight material such as benzene, diphenyl ether, etc., which is substantially inert to reaction with sulfur and the Mannich product under the reaction conditions. Selection of a suitable solvent/diluent is within the ordinary skill of the art. Sulfurization promoters such as dimethylformamide and dimethylsulfoxide can be used. When promoters are used, the reaction temperature can be lowered to about 75° C.

When it is desired to incorporate relatively high levels of sulfur in the Mannich product, for example, from about 5% to about 10%, it is helpful to carry out the reaction in the presence of a catalyst such as zinc stearate, zinc oxide, etc. The following examples illustrate the preparation of such sulfurized Mannich condensation products.

The following examples illustrate the procedure for reacting sulfur with Mannich products. Other examples, and further details of the procedure are found in U.S. Pat. No. 4,161,475 and the disclosure of this patent is hereby incorporated by reference.

EXAMPLE B-4-D (1) Benzene (217 parts) is added to phenol (324 parts, 3.45 moles) at 38° C. and the mixture is heated to 47° C. Boron trifluoride (8.8 parts, 0.13 mole) is added to the mixture over a one-half hour period at 38°–52° C. Polyisobutene (1000 parts, 1.0 mole) derived from the polymerization of $C_4$ monomers predominating in isobutylene is added to the mixture at 52°–58° C. over a 3.5 hour period. The mixture is held at 52° C. for one additional hour. A 26% solution of aqueous ammonia (15 parts) is added and the mixture heated to 70° C. over a 2 hour period. The mixture is then filtered and the filtrate is the desired crude polyisobutene-substituted phenol. This intermediate is stripped by heating 1465 parts to 167° C. and the pressure is reduced to 10 mm as the material is heated to 218° C. in a 6-hour period. A 64% yield of stripped polyisobutene-substituted phenol (Mn=885) is obtained as the residue.

(2) A commercial mixture of ethylene polyamines (41 parts, 1.0 equivalent) corresponding in empirical formula to penta(ethylene)hexamine is added to a mixture of the substituted phenol (400 parts, 0.38 equivalent) described in (1) and diluent oil (181 parts) at 65° C. The mixture is heated to 93° C. and paraformaldehyde (12 parts, 0.4 equivalent) added. The mixture is heated from 93°–140° C. over a 5-hour period and then held at 140° C. for 4 hours under nitrogen. The mixture is cooled to 93° C. and additional paraformaldehyde (12 parts, 0.4 equivalent) is added. The mixture is heated from 93°–160° C. for a total of 12 hours. The total amount of distillate collected is 13.2 parts. An additional amount of diluent oil (119 parts) is added to the mixture which is then filtered. The filtrate is a 40% oil solution of the desired Mannich condensation product containing 1.87% nitrogen.

(3) To 1850 parts (1.0 equivalent) of the Mannich condensate described in (2) is added sulfur flowers (64 parts, 2.0 equivalents) at 80° C. The mixture is heated to 160° C. over a 10-hour period removing the hydrogen sulfide evolved (35 grams). The mixture is then filtered. The filtrate is a 40% oil solution of the desired sulfurized product containing 1.79% nitrogen and 1.43% sulfur.

EXAMPLE B-4-E

The procedure of Example B-4-D is repeated except the polyisobutene-substituted phenol used has a Mw=4084/Mn=1292. To this substituted phenol (1400 parts, 0.75 equivalent) and diluent oil (374 parts) is added the ethylene polyamine of (2) (77 parts, 1.85 equivalents) at 80° C. The mixture is heated to 96° C. and sulfur flowers (42.7 parts, 1.33 equivalents) and paraformaldehyde (22.5 parts, 0.75 equivalent) is added. The mixture is heated to 150° C. over 3 hours under nitrogen. A total of 5 parts distillate is removed. The mixture is cooled to 120° C. and additional paraformaldehyde (22.5 parts, 0.75 equivalent) is added. The mixture is held at 120°–125° C. for one hour and then heated to 165° C. for 5 hours. An additional 12 parts distillate is removed. The mixture is filtered to provide as a filtrate a 20% oil solution of the desired product containing 0.83% nitrogen and a 0.27% sulfur.

Lubricating and Oil-Based Functional Fluid Composition

The lubricating compositions are based on diverse oils of lubricating viscosity, including natural and synthetic lubricating oils and mixtures thereof. These lubricating compositions containing the subject compositions are effective as crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metal-working lubricants, hydraulic fluids, and other lubricating oil and grease compositions can benefit from the incorporation of the compositions of the invention.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}O_{xo}$ acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)-sebacate, di-n-hexyl furmarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butyl-phenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally the lubricants and functional fluids of the present invention contain an amount of the phosphite ester (A) or the combination of the phosphite ester (A) and sulfur composition (B) sufficient to provide them with improved antioxidant, anti-wear and/or extreme pressure properties. Normally the amount of additive employed will be about 0.01% to about 20%, preferably about 0.1% to about 10% of the total weight of the lubricating or functional fluid composition. In lubricating compositions operated under extremely adverse conditions, such as lubricating compositions for marine diesel engines, the additive compositions of this invention may be present in amounts of up to about 30% by weight, or more, of the total weight of the lubricating composition.

The invention also contemplates the use of other additives in combination with the phosphite (A) or combination of phosphite (A) and sulfur composition (B). Such additives include, for example, detergents of the ash-producing type, corrosion- and oxidation-inhibiting agents, pour point depressing agents, extreme pressure agents, antiwear agents, color stabilizers and antifoam agents.

The ash-producing detergents are exemplified by oil-soluble neutral and basic salts of alkali or alkaline earth metals with sulfonic acids or carboxylic acids. The most commonly used salts of such acids are those of sodium, potassium, lithium, calcium, magnesium, strontium and barium.

The term "basic salt" is used to designate metal salts wherein the metal is present in stoichiometrically larger amounts than the organic acid group. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Auxiliary extreme pressure agents and corrosion- and oxidation-inhibiting agents which may be included in the lubricants of the invention are exemplified by chlorinated aliphatic hydrocarbons such as chlorinated wax; organic sulfides and polysulfides such as benzyl disulfide, bis-(chlorobenzyl)disulfide, dibutyl tetrasulfide, sulfurized methyl ester of oleic acid, and sulfurized terpenes. Group II metal phosphorodithioates include zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers.

The compositions of this invention can be added directly to the lubricant or functional fluid. Preferably, however, they are diluted with a substantially inert, normally liquid organic diluent such as mineral oil, naphtha, benzene, toluene or xylene, to form an additive concentrate. These concentrates usually contain from about 20% to about 90% by weight of the compositions of this invention and may contain, in addition, one or more other additives known in the art or described hereinabove. The remainder of the concentrate is the substantially inert normally liquid diluent.

The following are illustrative examples of the lubricating compositions of the present invention. All parts and percentages are by weight of the total composition unless otherwise indicated.

| | Parts by Weight |
|---|---|
| Lubricant A | |
| Base oil | 98 |
| Product of Example A-1 | 2 |
| Lubricant B | |
| Base oil | 98 |
| Product of Example A-4 | 2 |
| Lubricant C | |
| Base oil | 96 |
| Product of Example A-1 | 2 |
| Product of Example B-1-A | 2 |
| Lubricant D | |

-continued

| | Parts by Weight |
|---|---|
| Product of Example A-1 | 0.80 |
| Product of Example B-2-A | 0.75 |
| $C_9$ mono- and di-para-alkylated diphenylamine | 0.35 |
| basic sodium petroleum sulfonate | 0.25 |
| basic calcium petroleum sulfonate | 0.40 |
| silicone antifoam agent | 70 ppm |
| Base oil | remainder |

The lubricant compositions of the present invention may be in the form of lubricating oils and greases in which any of the above-described oils of lubricating viscosity can be employed as a vehicle. Where the lubricant is to be used in the form of a grease, the lubricating oil generally is employed in an amount sufficient to balance the total grease composition and generally, the grease compositions will contain various quantities of thickening agents and other additive components to provide desirable properties.

A wide variety of thickening agents can be used in the preparation of the greases of this invention. Included among the thickening agents are alkali and alkaline earth metal soaps of fatty acids and fatty materials having from about 12 to about 30 carbon atoms. The metals are typified by sodium, lithium, calcium and barium. Examples of fatty materials include stearic acid, hydroxy stearic acid, stearin, oleic acid, palmetic acid, myristic acid, cottonseed oil acids, and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Particularly useful thickening agents employed in the grease compositions are essentially hydrophilic in character, but which have been converted into a hydrophobic condition by the introduction of long chain hydrocarbon radicals onto the surface of the clay particles prior to their use as a component of a grease composition, as, for example, by being subjected to a preliminary treatment with an organic cationic surface-active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, and is believed to require no further discussion. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3% to 15% by weight of the total grease composition.

The invention also includes aqueous compositions characterized by an aqueous phase with at least one phosphite ester (A) or combination of phosphite ester (A) and sulfur compound (B) dispersed or dissolved in said aqueous phase. Preferably, this aqueous phase is a continuous aqueous phase, although in some embodiments the aqueous phase can be a discontinuous phase. These aqueous compositions usually contain at least about 25% by weight water. Such aqueous compositions encompass both concentrates containing about 25% to about 80% by weight, preferably from about 40% to about 65% water; and water-based functional fluids containing generally over about 80% by weight of water. The concentrates generally contain from about 10% to about 90% by weight of the composition of the invention. The water-based functional fluids generally contain from about 0.05% to about 15% by weight of compositions. The concentrates generally contain less than about 50%, preferably less than about 25%, more preferably less than about 15%, and still more preferably less than about 6% hydrocarbon oil. The water-based functional fluids generally contain less than about 15%, preferably less than about 5%, and more preferably less than about 2% hydrocarbon oil.

These concentrates and water-based functional fluids can optionally include other conventional additives commonly employed in water-based functional fluids. These other additives include surfactants; thickeners; oil-soluble, water-insoluble functional additives such as anti-wear agents, extreme pressure agents, dispersants, etc.; and supplemental additives such as corrosion-inhibitors, shear stabilizing agents, bactericides, dyes, water-softeners, odor masking agents, anti-foam agents and the like.

The concentrates are analogous to the water-based functional fluids except that they contain less water and proportionately more of the other ingredients. The concentrates can be converted to water-based functional fluids by dilution with water. This dilution is usually done by standard mixing techniques. This is often a convenient procedure since the concentrate can be shipped to the point of use before additional water is added. Thus, the cost of shipping a substantial amount of the water in the final water-based functional fluid is saved. Only the water necessary to formulate the concentrate (which is determined primarily by ease of handling and convenience factors), need be shipped.

Generally these water-based functional fluids are made by diluting the concentrates with water, wherein the ratio of water to concentrate is usually in the range of about 80:20 to about 99:1 by weight. As can be seen when dilution is carried out within these ranges, the final water-based functional fluid contains, at most, an insignificant amount of hydrocarbon oil.

In various preferred embodiments of the invention, the water-based functional fluids are in the form of solutions while in other embodiments they are in the form of micelle dispersions or microemulsions which appear to be true solutions. Whether a solution, micelle dispersion or microemulsion is formed is dependent, inter alia, on the particular components employed.

Also included within this invention are methods for preparing aqueous compositions, including both concentrates and water-based functional fluids, containing other conventional additives commonly employed in water-based functional fluids. These methods comprise the steps of:

(1) mixing the compositions of the invention with such other conventional additives either simultaneously or sequentially to form a dispersion or solution; optionally (2) combining said dispersion or solution with water to form said aqueous concentrate; and/or (3) diluting said dispersion or solution, or concentrate with water wherein the total amount of water used is in the amount required to provide the desired concentration of the composition of the invention and other functional additives in said concentrates or said water-based functional fluids.

These mixing steps are preferably carried out using conventional equipment and generally at room or slightly elevated temperatures, usually below 100° C. and often below 50° C. As noted above, the concentrate can be formed and then shipped to the point of use where it is diluted with water to form the desired water-based functional fluid. In other instances, the finished water-based functional fluid can be formed directly in the same equipment used to form the concentrate or the dispersion or solution.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, N.J., U.S.A., which is hereby incorporated by reference for its disclosures in this regard.

These surfactants, when used, are generally employed in effective amounts to aid in the dispersal of the various additives, particularly the functional additives discussed below, in the concentrates and water-based functional fluids of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 15% by weight of one or more of these surfactants.

Often the aqueous compositions of this invention contain at least one thickener for thickening said compositions. Generally, these thickeners can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Disclosures in this book relating to water-soluble thickening natural gums is hereby incorporated by reference. Specific examples of such gums are gum agar, guar gum, gum arabic, algin, dextrans, xanthan gum and the like. Also among the polysaccharides that are useful as thickeners for the aqueous compositions of this invention are cellulose ethers and esters, including hydroxy hydrocarbyl cellulose and hydrocarbylhydroxy cellulose and its salts. Specific examples of such thickeners are hydroxyethyl cellulose and the sodium salt of carboxymethyl cellulose. Mixtures of two or more of any such thickeners are also useful.

It is a general requirement that the thickener used in the aqueous compositions of the present invention be soluble in both cold (10° C.) and hot (about 90° C.) water. This excludes such materials as methyl cellulose which is soluble in cold water but not in hot water. Such hot-water-insoluble materials, however, can be used to perform other functions such as providing lubricity to the aqueous compositions of this invention.

Other useful thickeners are known to those of skill in the art and many can be found in the list in the aforementioned McCutcheon Publication: "Functional Materials," 1976, pp. 135–147, inclusive. The disclosures therein, relative to water-soluble polymeric thickening agents meeting the general requirements set forth above are hereby incorporated by reference.

Typically, the thickener is present in a thickening amount in the aqueous compositions of this invention. When used, the thickener is preferably present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

The functional additives that can be used in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as load-carrying agents.

The term "oil-soluble, water-insoluble functional additive" refers to a functional additive which is not soluble in water above a level of about 1 gram per 100 milliliters of water at 25° C., but is soluble in mineral oil to the extent of at least 1 gram per liter at 25° C.

These functional additives can also include certain solid lubricants such as graphite, molybdenum disulfide and polytetrafluoroethylene and related solid polymers.

These functional additives can also include frictional polymer formers. Briefly, these are potential polymer forming materials which are dispersed in a liquid carrier at low concentration and which polymerize at rubbing or contacting surfaces to form protective polymeric films on the surfaces.

The functional additive can also be a film former such as a synthetic or natural latex or emulsion thereof in water. Such latexes include natural rubber latexes and polystyrene butadienes synthetic latex.

The functional additive can also be an anti-chatter or anti-squawk agent. Examples of the former are the amide metal dithiophosphate combinations such as disclosed in West German Pat. No. 1,109,302; amine salt-azomethene combinations such as disclosed in British Patent Specification No. 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure as pertinent to anti-chatter and anti-squawk agents useful as a functional additive in the aqueous systems of the present invention.

Specific examples of functional additives useful in the aqueous systems of this invention include the following commercially available products.

TABLE I

| Functional Additive Tradename | Chemical Description | Supplier |
|---|---|---|
| Anglamol 32 | Chlorosulfurized hydrocarbon | Lubrizol[1] |
| Anglamol 75 | Zinc dialkyl phosphate | Lubrizol[1] |
| Molyvan L | A thiaphosphomolybdate | Vanderbilt[2] |
| Lubrizol-5315 | Sulfurized cyclic carboxylate ester | Lubrizol[1] |
| Emcol TS 230 | Acid phosphate ester | Witco[3] |

[1]The Lubrizol Corporation, Wickliffe, Ohio, U.S.A.
[2]R. T. Vanderbilt Company, Inc., New York, N.Y., U.S.A.
[3]Witco Chemical Corp., Organics Division, Houston, Texas, U.S.A.

Mixtures of two or more of any of the afore-described functional additives can also be used.

Typically, a functionally effective amount of the functional additive is present in the aqueous compositions of this invention.

The term "functionally effective amount" refers to a sufficient quantity of an additive to impart desired properties intended by the addition of said additive. For example, if an additive is a rust-inhibitor, a functionally effective amount of said rust-inhibitor would be an amount sufficient to increase the rust-inhibiting characteristics of the composition to which it is added. Similarly, if the additive is an anti-wear agent, a functionally effective amount of said anti-wear agent would be a sufficient quantity of the anti-wear agent to improve the anti-wear characteristics of the composition to which it is added.

The aqueous systems of this invention often contain at least one inhibitor for corrosion of metals. These inhibitors can prevent corrosion of either ferrous or non-ferrous metals (e.g., copper, bronze, brass, titanium, aluminum and the like) or both. The inhibitor can be organic or inorganic in nature. Usually it is sufficiently soluble in water to provide a satisfactory inhibiting action though it can function as a corrosion-inhibitor without dissolving in water, it need not be water-soluble. Many suitable inorganic inhibitors useful in the aqueous systems of the present invention are known to those skilled in the art. Included are those described in "Protective Coatings for Metals" by Burns and Bradley, Reinhold Publishing Corporation, Second Edition, Chapter 13, pages 596–605. This disclosure relative to inhibitors are hereby incorporated by reference.

The aqueous systems of the present invention can also include such other materials as dyes, e.g., an acid green dye; water softeners, e.g., ethylene diamine tetraacetate sodium salt or nitrilo triacetic acid; odor masking agents, e.g., citronella, oil of lemon, and the like; and anti-foamants, such as the well-known silicone anti-foamant agents.

The aqueous systems of this invention may also include an anti-freeze additive where it is desired to use the composition at a low temperature. Materials such as ethylene glycol and analogous polyoxyalkylene polyols can be used as anti-freeze agents. Clearly, the amount used will depend on the degree of anti-freeze protection desired and will be known to those of ordinary skill in the art.

It should also be noted that many of the ingredients described above for use in making the aqueous systems of this invention are industrial products which exhibit or confer more than one property on such aqueous compositions. Thus, a single ingredient can provide several functions thereby eliminating or reducing the need for some other additional ingredient. Thus, for example, an extreme pressure agent such as tributyl tin oxide can also function as a bactericide.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A composition comprising the combination of (A) at least one phosphite ester characterized by the formula:

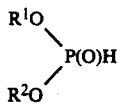

(I)

wherein $R^1$ is a straight-chain hydrocarbyl group which contains up to about 12 carbon atoms and $R^2$ is a branched-chain hydrocarbyl group which contains up to about 12 carbon atoms, and (B) at least one sulfur-containing composition comprising (B-1) at least one sulfurized olefin;

(B-2) a hydroxy thioether of the formula

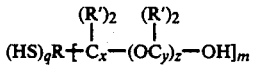

(II)

wherein R is a hydrocarbyl group of up to about 30 carbon atoms and having a valence of m+q; each R′ is independently hydrogen or a hydrocarbyl group of up to about 20 carbon atoms; x and y are each independently an integer of from 2 to about 5; z is an integer of from 0 to about 5; q is an integer of from 0 to about 4; and m is an integer of from 1 to about 5 with the proviso that the sum of m+q is from 1 to 6;

(B-3) nitrogen- and sulfur-containing compositions obtained by the reaction of at least one amino compound, carbon disulfide and either hydrocarbon-substituted carboxylic acids or halogenated aliphatic hydrocarbons; or (B-4) sulfurized and/or carbon disulfide reacted Mannich condensation products.

2. The composition of claim 1 wherein $R^1$ is an alkyl group containing from 1 to about 12 carbon atoms and $R^2$ is an alkyl group containing from 4 to about 12 carbon atoms.

3. The composition of claim 1 wherein (B) is a sulfurized olefin (B-1) prepared by reacting sulfur and/or a sulfur halide with at least one olefin characterized by the formula $$R^1R^2C{=}CR^3R^4 \quad \text{(III)}$$

wherein $R^1$, $R^2$, $R^3$ and $R^4$ are, independently, hydrogen or any organic group, and the olefinic double bond is a non-aromatic double bond.

4. The composition of claim 1 wherein (B) is a sulfurized olefin (B-1) which is at least one sulfurized terpene compound.

5. The composition of claim 1 wherein (B) is a sulfurized olefin (B-1) which is the reaction product of a sulfur source and a Diels-Alder adduct.

6. The composition of claim 1 wherein (B) is (B-1) and is a sulfurized unsaturated fatty acid or sulfurized unsaturated fatty acid ester.

7. The composition of claim 1 wherein (B) is a sulfurized olefin (B-1) obtained by sulfurizing a mixture of at least one terpene and at least one other olefinic compound.

8. The composition of claim 7 wherein the other olefinic compound is (i) at least one aliphatic, aryl aliphatic or alicyclic olefinic hydrocarbon containing at least about 3 carbon atoms, (ii) at least one unsaturated fatty acid or unsaturated fatty acid ester, or (iii) mixtures thereof.

9. The composition of claim 1 wherein (B) is a sulfurized olefin (B-1) which is a sulfurized Diels-Alder adduct of at least one dienophile with at least one aliphatic conjugated diene.

10. The composition of claim 1 wherein (B) is (B-2) wherein q in Formula II is zero and R is a saturated hydrocarbon.

11. The composition of claim 10 wherein x is 2, z is 0 and m is 1.

12. The composition of claim 1 wherein (B) is a sulfurized Mannich condensation product (B-4) derived from (i) a substituted phenol containing up to about 400 carbon atoms in a substituent, (ii) an aliphatic based aldehyde and (iii) an amino compound.

13. The composition of claim 1 wherein (B) is a nitrogen- and sulfur-containing composition (B-3) obtained by reaction of (i) at least one amino compound, (ii) hydrocarbon-substituted carboxylic acid and (iii) carbon disulfide.

14. The composition of claim 13 wherein the hydrocarbon-substituted carboxylic acid is a hydrocarbon-substituted dicarboxylic acid.

15. A composition comprising the combination of (A) at least one phosphite ester characterized by the formula

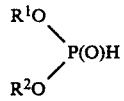

(I)

wherein $R^1$ is a straight-chain hydrocarbyl group containing from 1 to about 12 carbon atoms and $R^2$ is a branched-chain hydrocarbyl group containing from 4 to about 12 carbon atoms, and (B-1) at least one sulfurized olefin.

16. A composition comprising the combination of (A) at least one phosphite ester characterized by the formula

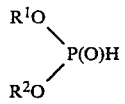

(I)

wherein $R^1$ is a straight-chain hydrocarbyl group containing from 1 to about 12 carbon atoms and $R^2$ is a branched-chain hydrocarbyl group containing from 4 to about 12 carbon atoms, and (B-2) at least one hydroxy thioether of the formula

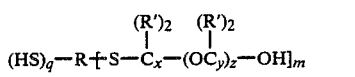

(II)

wherein R is a hydrocarbyl group of up to about 30 carbon atoms and having a valence of m+q; each R' independently selected from hydrogen in a hydrocarbyl group of up to about 20 carbon atoms; x and y are each independently an integer of from 2 to about 5; z is an integer of from 0 to about 5; q is an integer of from 0 to about 4; and m is an integer of from 1 to about 5 with the proviso that the sum of m+q is from 1 to 6.

17. A composition comprising the combination of

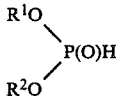

(I)

wherein $R^1$ is a straight-chain hydrocarbyl group containing from 1 to about 12 carbon atoms and $R^2$ is a branched-chain hydrocarbyl group containing from 4 to about 12 carbon atoms, and (B-3) at least one nitrogen and sulfur-containing composition obtained by the reaction of (i) at least one amino compound, (ii) a hydrocarbon-substituted dicarboxylic acid and (iii) carbon disulfide.

18. A lubricant or functional fluid composition comprising a major amount of at least one oil of lubricating viscosity and an effective extreme-pressure and friction-modifying amount of (A) at least one phosphite ester characterized by the formula

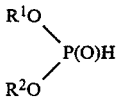

(I)

wherein $R^1$ is a straight-chain hydrocarbyl group which contains up to about 12 carbon atoms and $R^2$ is a branched-chain hydrocarbyl group which contains up to about 12 carbon atoms.

19. The composition of claim 18 wherein $R^1$ is an alkyl group containing from 1 to about 12 carbon atoms and $R^2$ is an alkyl group containing from 4 to about 12 carbon atoms.

20. The composition of claim 18 wherein the composition contains from about 0.01 to about 20% by weight of the phosphite (A).

21. A lubricating or functional fluid composition comprising a major amount of at least one oil of lubricating viscosity and an effective amount of an extreme pressure and/or friction-modifying composition of claim 1.

22. A lubricating or functional fluid composition comprising a major amount of at least one oil of lubricating viscosity and an effective amount of an extreme pressure and/or friction-modifying composition of claim 15.

23. A lubricating or functional fluid composition comprising a major amount of at least one oil of lubricating viscosity and an effective amount of an extreme pressure and/or friction-modifying composition of claim 16.

24. A lubricating or functional fluid composition comprising a major amount of at least one oil of lubricating viscosity and an effective amount of an extreme pressure and/or friction-modifying composition of claim 17.

25. An automatic transmission fluid composition having improved frictional and/or extreme pressure characteristics comprising a major amount of at least one oil of lubricating viscosity and an effective amount of (A) at least one phosphite ester of the formula

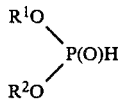

(I)

wherein $R^1$ is a straight-chain hydrocarbyl group and $R^2$ is a branched-chain hydrocarbyl group, the hydrocarbyl groups containing up to about 12 carbon atoms.

26. The fluid of claim 25 containing from about 0.01 to about 20% by weight of the phosphite (A).

27. The fluid of claim 25 wherein the hydrocarbyl group $R^1$ contains from 1 to about 12 carbon atoms and the hydrocarbyl group $R^2$ contains from about 4 to about 12 carbon atoms.

28. An automatic transmission fluid composition having improved frictional and/or extreme pressure characteristics comprising a major amount of at least one oil of lubricating viscosity and an effective amount of the composition of claim 1.

29. The composition of claim 18 wherein the composition is a lubricating oil or a grease.

30. The composition of claim 21 wherein the composition is a lubricating oil or grease.

31. An additive concentrate comprising a substantially inert, normally liquid diluent and about 20–90% by weight of at least one phosphite ester characterized by the formula

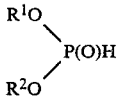

(I)

wherein $R^1$ is a straight chain hydrocarbyl group which contains up to about 12 carbon atoms and $R^2$ is a branched chain hydrocarbyl group which contains up to about 12 carbon atoms

32. An additive concentrate comprising a substantially inert, normally liquid diluent and about 20–90% by weight of at least one composition of claim 1.

33. An aqueous system comprising at least about 40% of water and at least one phosphite ester characterized by the formula

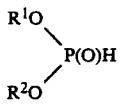

(I)

wherein $R^1$ is a straight chain hydrocarbyl group which contains up to about 12 carbon atoms and $R^2$ is a branched chain hydrocarbyl group which contains up to about 12 carbon atoms.

34. An aqueous composition comprising at least about 40% by weight of water and at least one composition of claim 1.

35. An aqueous composition comprising at least about 40% by weight of water and at least one composition of claim 15.

36. An aqueous composition comprising at least about 40% by weight of water and at least one composition of claim 16.

37. An aqueous composition comprising at least about 40% by weight of water and at least one composition of claim 17.

* * * * *